US007735882B2

(12) United States Patent
Abdollahzadeh et al.

(10) Patent No.: US 7,735,882 B2
(45) Date of Patent: Jun. 15, 2010

(54) FLUSH-MOUNTING MULTIPOINT LOCKING SYSTEM

(75) Inventors: Joshua Abdollahzadeh, High Point, NC (US); Bruce Procton, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 126 days.

(21) Appl. No.: 11/548,410

(22) Filed: Oct. 11, 2006

(65) Prior Publication Data

US 2008/0087052 A1 Apr. 17, 2008

(51) Int. Cl.
*E05C 3/06* (2006.01)

(52) U.S. Cl. ..... 292/44; 292/47; 49/367

(58) Field of Classification Search ..... 292/47; 49/366–369, 371

See application file for complete search history.

(56) References Cited

U.S. PATENT DOCUMENTS

| | | | | | |
|---|---|---|---|---|---|
| 618,305 | A | | 1/1899 | Weaver | |
| 823,943 | A | | 6/1906 | Gilleland | |
| 1,077,433 | A | | 11/1913 | Schlis | |
| 2,610,368 | A | * | 9/1952 | Tschaepe | 49/319 |
| 2,753,020 | A | * | 7/1956 | Ware, Jr. | 49/318 |
| 3,656,788 | A | | 4/1972 | Emery | |
| 3,788,679 | A | | 1/1974 | Banham | |
| 3,919,808 | A | * | 11/1975 | Simmons | 49/367 |
| 3,940,886 | A | * | 3/1976 | Ellingson, Jr. | 49/319 |
| 4,429,493 | A | | 2/1984 | St. Aubin | |
| 4,644,696 | A | | 2/1987 | Bursk | |
| 4,999,950 | A | | 3/1991 | Beske et al. | |
| 5,197,771 | A | * | 3/1993 | Kaup et al. | 292/45 |
| 5,290,077 | A | | 3/1994 | Fleming | |
| 5,350,207 | A | * | 9/1994 | Sanders | 292/335 |
| 5,638,639 | A | * | 6/1997 | Goodman et al. | 49/7 |
| 5,722,704 | A | * | 3/1998 | Chaput et al. | 292/26 |
| 5,782,114 | A | | 7/1998 | Zeus et al. | |
| 5,857,291 | A | | 1/1999 | Headrick | |
| 5,906,403 | A | * | 5/1999 | Bestler et al. | 292/26 |
| 6,282,929 | B1 | | 9/2001 | Eller et al. | |
| 6,457,751 | B1 | | 10/2002 | Hartman | |
| 6,491,326 | B1 | | 12/2002 | Massey et al. | |
| 6,971,686 | B2 | * | 12/2005 | Becken | 292/39 |
| 7,543,860 | B2 | * | 6/2009 | Meeks et al. | 292/137 |
| 2007/0283629 | A1 | * | 12/2007 | Phipps | 49/368 |

* cited by examiner

*Primary Examiner*—Gary Estremsky
(74) *Attorney, Agent, or Firm*—Womble Carlyle Sandridge & Rice PLLC

(57) ABSTRACT

A surface-mounting multipoint lock includes an elongated housing having a lower end, an upper end, and a mounting member. The lock is configured for attachment along and external to a non-hinged vertical edge of a swinging panel along substantially a full extent of the non-hinged vertical edge. A plurality of spaced latch bolts in the housing include an upper latch bolt proximate to the upper end of the housing, and a lower latch bolt proximate to the lower end of the housing. The latch bolts are substantially laterally movable between a locked position and an unlocked position.

8 Claims, 25 Drawing Sheets

FLUSH-MOUNTING MULTIPOINT LOCKING SYSTEM

FIELD OF THE INVENTION

The invention generally relates to locks, and more particularly relates to a surface-mounting multi-point locking astragal for an active swinging closure panel for securing the non-hinged edge of the active panel at multiple vertically spaced points, such as points along an adjacent jamb, frame member, or fixed non-hinged edge of a cooperating inactive swinging panel.

BACKGROUND

Exterior entryways of modern homes and buildings often include cooperating pairs of swinging doors commonly referred to as double doors or French doors. Such doors include an inactive swinging door panel, and an adjacent active swinging door panel. The sets of doors may swing inwardly into the structure (so-called "inswing" doors), or may swing outwardly from the structure (so-called "outswing" doors). The inactive door panel typically includes a generally T-shaped astragal mounted along the entire extent of its non-hinged vertical edge. As used herein, the term "astragal" generally means an elongated member attached to and substantially coextensive with the non-hinged vertical edge of one of a pair of swinging double doors. In a conventional arrangement, an astragal is mounted along the non-hinged vertical edge of an inactive door panel, and provides a stop against which a cooperating active door panel strikes when both door panels are closed.

In its simplest form, an astragal consists of a single length of wooden molding attached along the non-hinged edge of an inactive door panel by screws, nails, or the like. Such simple astragals serve no role in fixing an inactive swinging door panel in a closed position in a doorway. Instead, special unrelated locking hardware is required for that purpose. Typically, such locking hardware is internally mounted within specially formed pockets or recesses within the body of the inactive door panel. Such pockets or recesses must be specially formed in the edge of the door by routing, milling, chiseling, or the like. The locking hardware typically includes independently operable top and bottom vertically sliding bolts received in specially drilled bores in the top and bottom of the inactive door panel proximate to the door panel's non-hinged vertical edge. When extended, the top and bottom vertical bolts selectively engage aligned pockets or holes in the top jamb and doorsill of the associated doorway, thereby fixing the inactive door panel in a closed position. When retracted, the top and bottom vertical bolts permit the door panel to swing open. Both the top and bottom vertical bolts typically are actuated by either a slide or lever mechanism installed along the non-hinged vertical edge of the inactive door panel.

Some modern astragals for inactive door panels include vertically moveable top and bottom bolts disposed in a flush-mounted elongated housing. One such astragal is described in U.S. Pat. No. 6,491,326 to Endura Products, Inc., for example. Like the simple astragal described above, the housing of such locking astragals is surface-mounted along the non-hinged vertical edge of an inactive door panel, and provides a stop for a cooperating active door panel. When the inactive panel is closed and the top and bottom bolts are vertically extended, the top and bottom bolts are respectively received in pockets or holes in the top jamb and doorsill of the associated doorway, thereby fixing the inactive panel in a closed position. In order to permit the inactive panel to be opened, the top and bottom bolts can be selectively retracted from their associated pockets or holes in the doorframe. The top and bottom bolts can be vertically extended and retracted by a lever or slide actuating mechanism disposed within the housing. Unlike vertically sliding locking bolt mechanisms that must be internally installed within specially formed recesses or pockets in a door, such locking astragals can be installed relatively easily on a substantially planar external surface or surfaces of an inactive door panel.

The active door panel of a pair of double swinging doors commonly includes conventional locking door hardware. Such hardware may include a conventional door handle lockset like that used for a single swinging door. In such an arrangement, the bolt of the lockset is received in an aligned strike plate recess milled in the non-hinged vertical edge of the cooperating inactive door panel, or in an astragal attached along the non-hinged vertical edge of the cooperating inactive door panel. For added security, a conventional deadbolt also may be installed in the active door panel. Like the lockset bolt described above, the bolt of the deadbolt is received in an aligned strike plate recess milled in the non-hinged vertical edge of the cooperating inactive door panel or an associated astragal.

For further additional security, multipoint locking systems are known that can be specially installed within the non-hinged vertical edge of an active door panel. In such an arrangement, a lock case is recessed within a specially milled lock case pocket in the non-hinged vertical edge of an active swinging door panel. The lock case encloses an actuating mechanism. Upper and lower actuating rods or bars upwardly and downwardly extend from the lock case to upper and lower latch bolt housings, respectively. The independent upper and lower latch bolt housings contain latch bolt mechanisms, and are recessed within specially formed latch bolt pockets or recesses in the non-hinged vertical edge of the active swinging door panel. Operation of the actuating mechanism causes selective vertical movement of the actuating rods or bars, which in turn cause a latch bolt to laterally extend and outwardly protrude from each latch bolt housing. When extended, each latch bolt engages a mating opening or recess in an adjacent frame member, inactive door panel, astragal, or the like, thereby securing the active door panel in a closed position. An elongated faceplate may be attached to the edge face of the vertical edge of the door to conceal portions of the mechanism that are recessed within the edge of the door. Preferably, the upper latch bolt is positioned proximate to a top of the door's vertical edge, and the lower latch bolt is positioned proximate to a bottom of the door's edge. Similar recessed devices are known that include vertically extending latchbolts. Multipoint latching systems of this type are known to provide a stronger, more secure closure than single-point locks positioned at or near the mid-height of a door. Unfortunately, such multi-point locks are difficult and costly to install due to the extensive preparation of the door edges required to assemble the recessed portions of the locking mechanisms in the doors.

Accordingly, there is a need for a surface-mounting multipoint door locking system for the non-hinged vertical edge of an active swinging door panel. Furthermore, there is a need for a multi-point locking device that provides the added security of known recessed multi-point door locking systems, but does not require custom preparation of a door's edge in order to install the device. In addition, there is a need for a surface-mounting locking device for the active panel of a pair of double swinging doors that cooperates with a locking astragal on an associated inactive door panel to positively secure both doors in a closed position.

SUMMARY

The invention includes a multipoint locking system for a pair of cooperating swinging panels that includes an active panel and an inactive panel. The system includes an astragal configured to be externally mounted along a non-hinged vertical edge of the inactive panel. The astragal is operable to selectively fix the inactive panel in a closed position, and includes a plurality of spaced openings therealong. The system further includes a locking mechanism having an elongated housing configured to be externally mounted along a non-hinged vertical edge of the active panel, and a plurality of spaced latch bolts movably disposed in the housing. Each latch bolt is movable between a locked position and an unlocked position, and is aligned with one of the spaced openings in the astragal. At least one actuator positioned within the housing is operable to move the latch bolts between their locked and unlocked positions. When the active panel and the inactive panel are closed and the latch bolts are moved to their locked positions, each of the latch bolts is received in its aligned opening in the astragal, thus fixing the active panel in a closed position.

The invention also includes a multipoint lock. The lock includes an elongated housing configured to extend along substantially the entire length of an external surface along a non-hinged vertical edge of a swinging panel. The housing has an upper end, a lower end, and a vertical axis. The lock further includes at least two latch bolts movably disposed in the housing, including a first latch bolt proximate to the upper end, and a second latch bolt proximate to the lower end. The latch bolts are extendable and retractable in a direction that is substantially transverse to the vertical axis of the housing. At least one actuator is operable to selectively cause the first and second latch bolts to move between an extended position and a retracted position.

The invention also includes a multipoint lock with an elongated housing having a lower end, an upper end, and a mounting member configured for attachment along and external to a non-hinged vertical edge of a swinging panel along substantially a full extent of the non-hinged vertical edge. A plurality of spaced latch bolts in the housing include an upper latch bolt proximate to the upper end of the housing, and a lower latch bolt proximate to the lower end of the housing. The latch bolts are substantially laterally movable between a locked position and an unlocked position.

The invention further includes a lock for a swinging closure panel having a non-hinged vertical edge. The lock includes a latching means that selectively engages the lock with a fixed vertical member at multiple points along the vertical member. The latching means is external to the closure panel. The lock also includes an actuating means for selectively causing the latching means to engage and disengage from the vertical member. The actuator means also is external to the closure panel. The lock further includes a covering means that substantially covers the latching means and the actuator means, and is external to the closure panel. The covering means extends along substantially a full extent of the non-hinged vertical edge of the closure panel. The lock also includes mounting means for externally mounting the lock along substantially the full extent of the non-hinged vertical edge of the closure panel.

These and other aspects of the invention will be understood from a reading of the following description together with the drawings.

DETAILED DESCRIPTION

Figure 1:
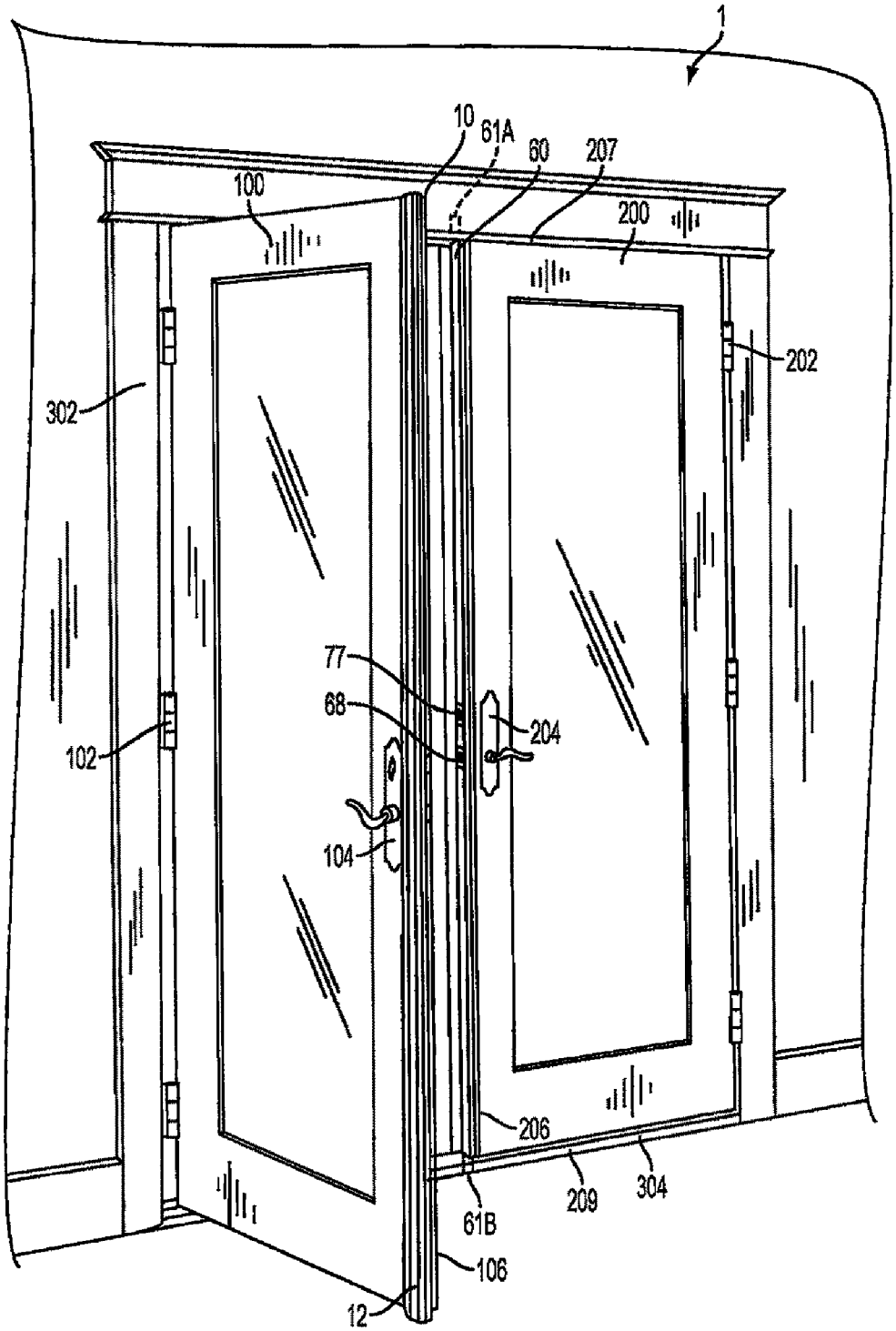
FIG. 1 is an indoor perspective view of an inswing double-door entryway that includes a multi-point locking system according the invention.

FIG. 1 shows an inswing double-door entryway 1 that includes an inactive door panel 200 and an active door panel 100. The inactive and active door panels 200, 100 are mounted by hinges 202, 102 such that both door panels 200, 100 open by swinging inwardly in the entryway 1. As used herein, the term "inactive door panel" means a swinging door panel that can be selectively fixed in an entryway in a closed or shut position. As shown in FIG. 1, the inactive door panel 200 can be fixed in its closed position by an inactive door panel locking astragal 60 (hereinafter referred to as an "inactive locking astragal") that is externally mounted along substantially the entire extent of the surface of the non-hinged vertical edge 206 of the inactive door panel 200. As used herein, the terms "externally mounted" and "surface mounted" mean mounted on one or more substantially planar outer surfaces of a panel, such that no substantial portion of an object so mounted is received in a specially-prepared pocket, recess, channel, cavity, etc. in or along the receiving edge of the panel, excluding insubstantial penetrations such as screw holes, nail holes, and the like.

As shown in FIG. 1, the inactive door panel locking astragal 60 includes upper and lower vertically movable flush bolts 61A, 61B. The flush bolts 61A, 61B can be selectively moved between an extended locked position, and a retracted unlocked position by one or more associated actuating mechanisms of a type well known in the art. For example, the flush bolt and actuating mechanisms of the inactive locking astragal 60 may be like those described in U.S. Pat. No. 6,491,326 to Endura Products, Inc., which hereby is incorporated by reference in its entirety. In a locked position, the upper flush bolt 61A selectively and vertically engages an aligned recess in the entryway header 207, and the lower flush bolt 61B selectively and vertically engages an aligned recess in the doorsill or threshold 209, thereby securely blocking movement of the inactive door panel 200. As shown in FIG. 1, an active door multipoint lock 10 can be surface mounted along the entire extent of the non-hinged vertical edge 106 of the active door panel 100.

Figure 2:
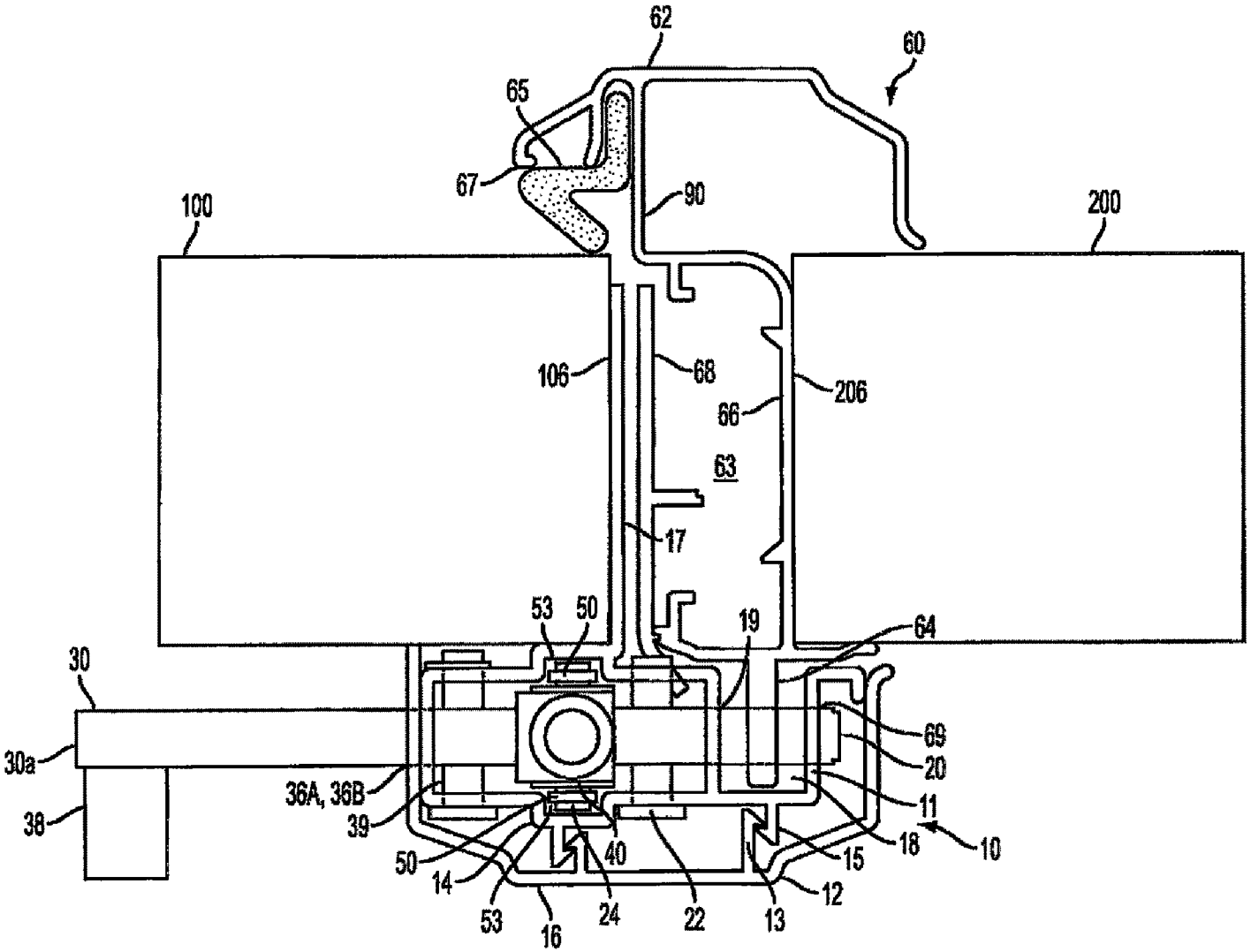
FIG. 2 is a plan cross-sectional view of one embodiment of a multi-point locking system according to the invention for an inswing double-door entryway like that shown in FIG. 1.
Figure 3:
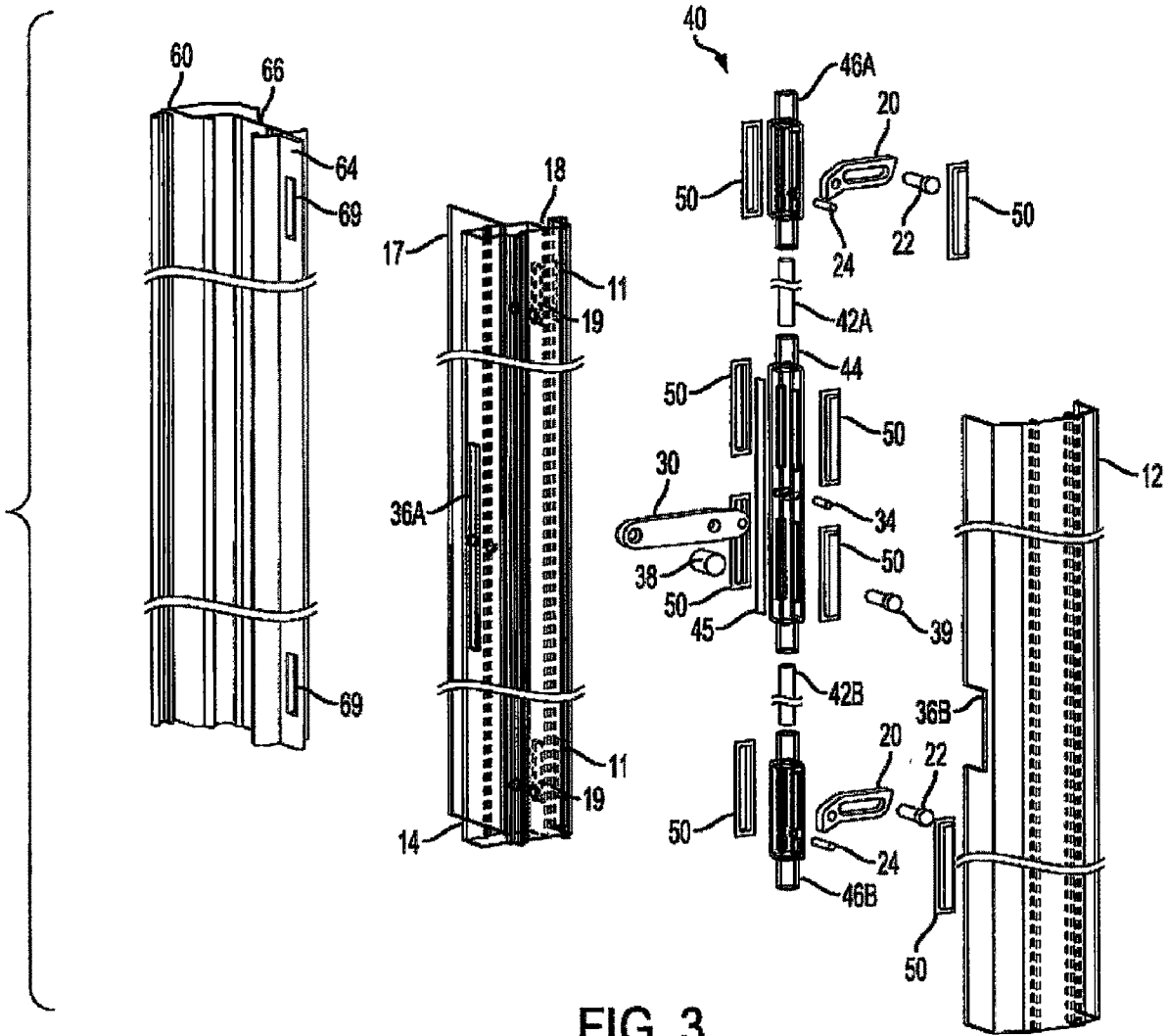
FIG. 3 is an exploded perspective view of the multi-point locking system shown in FIG. 2.
Figure 4:
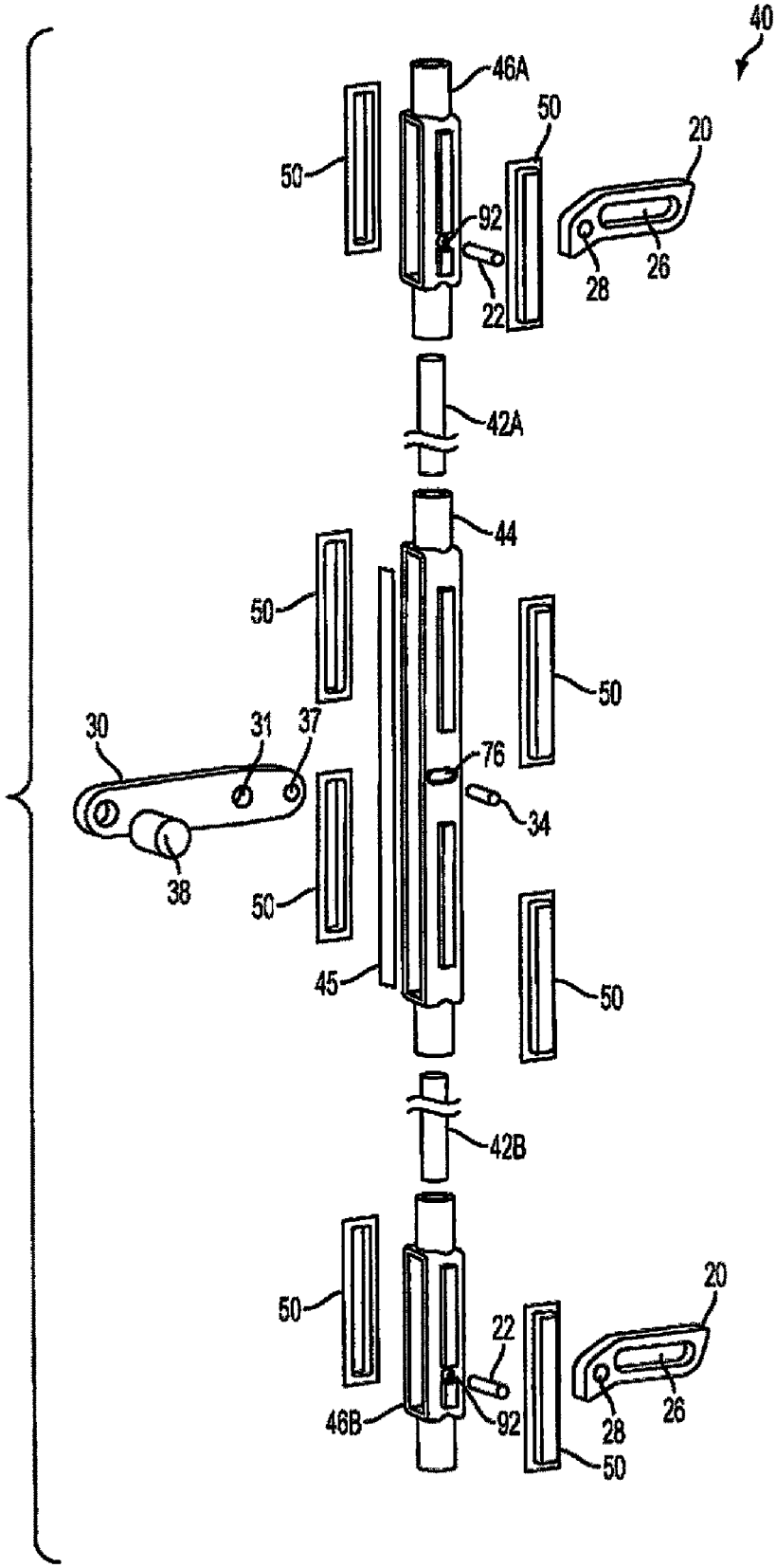
FIG. 4 is an exploded perspective view of the latching mechanism portion of the multi-point locking system shown in FIGS. 2-3.
Figure 5:
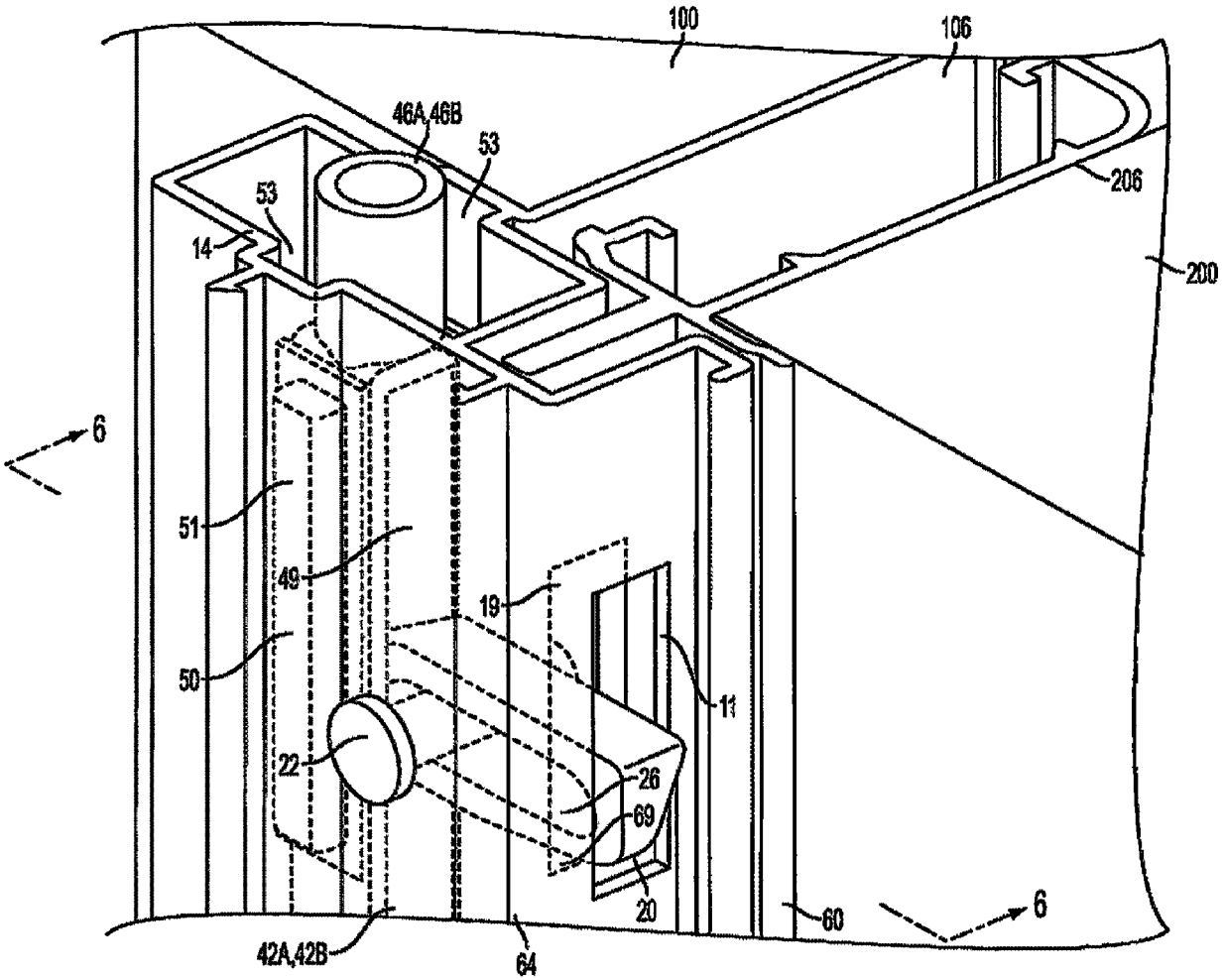
FIG. 5 is a detail perspective view of a portion of the multi-point locking system shown in FIGS. 2-3.

FIGS. 2-7 show details of one embodiment of the multipoint lock 10 and the cooperating inactive locking astragal 60. As shown in FIG. 2, the inactive locking astragal 60 includes a frame 90 having a mounting plate 66 that externally mounts to an outer surface along the non-hinged vertical edge 206 of the inactive door panel 200. The mounting plate 66 can be externally mounted to the door's edge 206 by a plurality of screws (not shown). Alternatively, the mounting plate 66 may be attached to the door's edge 206 by nails, an adhesive material, or the like. The frame 90 also includes a stop portion 67 that provides a positive stop for the active door panel 100 in its closed position. A cover portion 62 covers one side of a vertical gap between the active and inactive door panels 100, 200. An internal cavity 63 in the inactive astragal 60 receives the upper and lower flush bolts 61A, 61B (see FIG. 1) and an associated actuating mechanism of a type known to persons of ordinary skill in the art. Preferably, the frame 90 is constructed of extruded aluminum. Alternatively, the frame 90 may be constructed of an extruded plastic material, steel, pultruded fiberglass, or any other strong, durable and extrudable material. The inactive locking astragal 60 also may include a resilient weather strip 65 that forms a weather resistant seal between the inactive astragal 60 and the closed active door panel 100. A removable strike plate 68 or the like may at least partially cover the internal cavity 63 of the frame 90. In this embodiment, the inactive locking astragal 60 includes a latch member 64. As best seen in FIGS. 3 and 5, the latch member 64 includes at least two apertures 69 spaced apart along its length.

Figure 18:
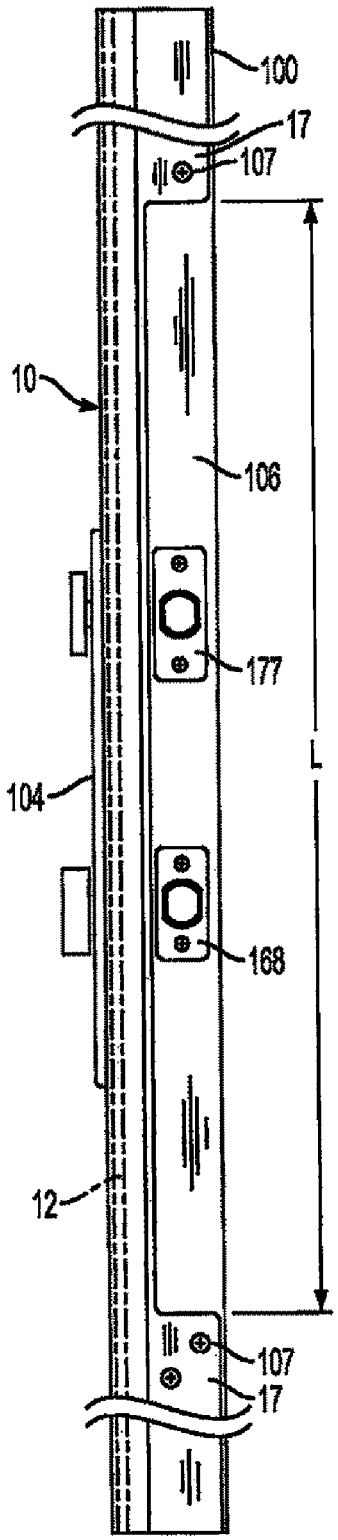
FIG. 18 is an elevation view of a non-hinged vertical edge of an active door panel with a multipoint lock like that shown in FIG. 2 installed therealong.

Returning to FIG. 2, the active door multipoint lock 10 can include an elongated housing 12. Preferably, the housing 12 is sufficiently long to extend along substantially the full extent of the non-hinged vertical edge 106 of the active door panel 100 (see FIG. 1). As shown in FIG. 2, the housing 12 may include a base 14, and a selectively removable cover 16. The base 14 and cover 16 can be constructed of extruded aluminum. Alternatively, the base 14 and/or cover 16 can be constructed of an extruded plastic material, steel, or any other durable and extrudable material. In one embodiment, the base 14 is constructed of aluminum, and the cover 16 is constructed of a durable and tough vinyl material. The cover 16 may be removably connected to the base portion 14 by cooperating resilient hooks 13, 15 or any other suitable connecting arrangement. In this embodiment, the cover 16 and portions of the base 14 can combine to cover a second side of the elongated vertical gap between the active and inactive door panels 100, 200. The base 14 can include a mounting plate 17 configured to externally mount to one or more outer surfaces along the edge face of the non-hinged vertical edge 106 of the active door panel 100. Preferably, the mounting plate 17 is affixed to the door's edge 106 by a plurality of screws 107 as shown in FIG. 18. Alternatively, the mounting plate 17 can be affixed to the door's edge 106 by nails, an adhesive material, or any other suitable means.

Figure 19:
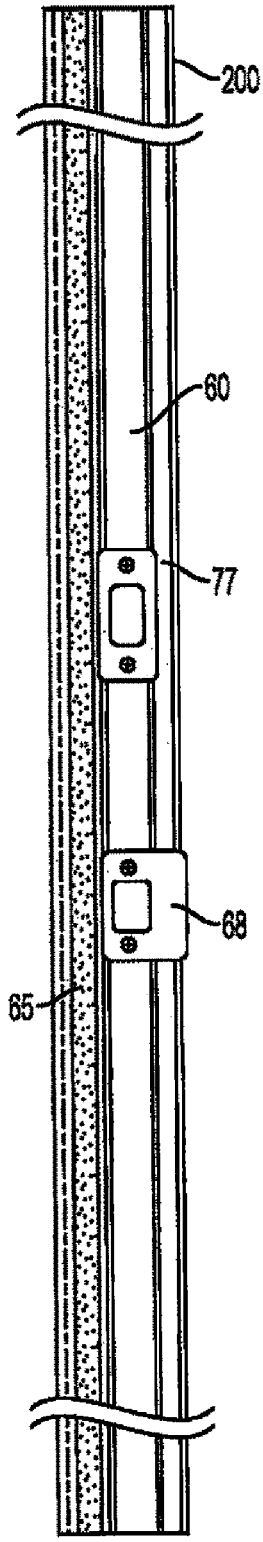
FIG. 19 is an elevation view of a non-hinged vertical edge of an inactive door panel with an inactive door panel locking astragal like that shown in FIG. 2 installed therealong.

As shown in FIG. 18, the mounting plate 17 can be discontinuous, and can include at least one cutout portion along a portion of its length (as indicated by extent "L" in FIG. 18, for example). The cutout portion can coincide with those portions of the non-hinged edge 106 of an active door panel 100 that receive a dead-bolt latch assembly 177 and a doorknob bolt assembly 168. Thus, the multi-point lock 10 will not interfere with conventional installation of a dead-bolt latch assembly 177 and/or a doorknob bolt assembly 168 along the non-hinged vertical edge 106 of the active panel 100. As shown in FIG. 19, the inactive locking astragal 60 can be configured to receive a conventional deadbolt strike plate 77 and door knob strike plate 68 that align with the dead-bolt latch assembly 177 and door knob bolt assembly 168 on the mating active door panel 100.

As shown in FIG. 2, the base 14 and cover 16 of the multi-point lock 10 can be configured such that they can be externally mounted to one or more outer surfaces along the square edge 106 of the active door panel 100 without special edge preparation. In other words, the base 14 and cover 16 can be configured to be mounted on and along the substantially planar surface(s) forming the active door's edge 106 in the absence of specially prepared pockets, recesses, channels, bores, or the like.

FIGS. 2-8, 18 and 19 show various features of one embodiment of a latching mechanism 40 for the active door multipoint locking astragal 10. As shown in FIG. 2, the base 14 includes a channel 18 configured to receive the latch member 64 of the inactive locking astragal 60 when the active and inactive door panels 100, 200 are closed in an entryway. The base 14 also includes a pair of opposed elongated channels 53. As shown in FIG. 2, an elongated latching mechanism (generally indicated by reference numeral 40) can be slidably disposed between the channels 53. An actuator lever 30 can be pivotally mounted in the base 14 by a fulcrum pin 39, and selectively control the vertical position of the latching mechanism 40 in the channels 53. As shown in FIGS. 3 and 4, the latching mechanism 40 can include an upper slide 46A and a lower slide 46B. Preferably, the upper and lower slides 46A, 46B are substantially identical to each other. The upper and lower slides 46A, 46B can be respectively connected to an actuator slide 44 by elongated connecting rods 42A, 42B. Preferably, the ends of the actuator rods 42A, 42B are threaded, and are received in cooperating threaded bores in the respective ends of the upper and lower slides 46A, 46B and the actuator slide 44. Durable and friction-resistant slide bearings 50 can be provided on the upper and lower slides 46A, 46B and/or the actuator slide 44 to permit unhindered sliding movement of the slides 44, 46A, 46B in the channels 53 of the base 14 (see FIG. 2). In one embodiment, the slide bearings 50 are constructed of a self-lubricating resin or metal. Alternatively, the slide bearings can be constructed of plastic, polytetrafluoroethylene, or any other suitable bearing material.

Figure 7:
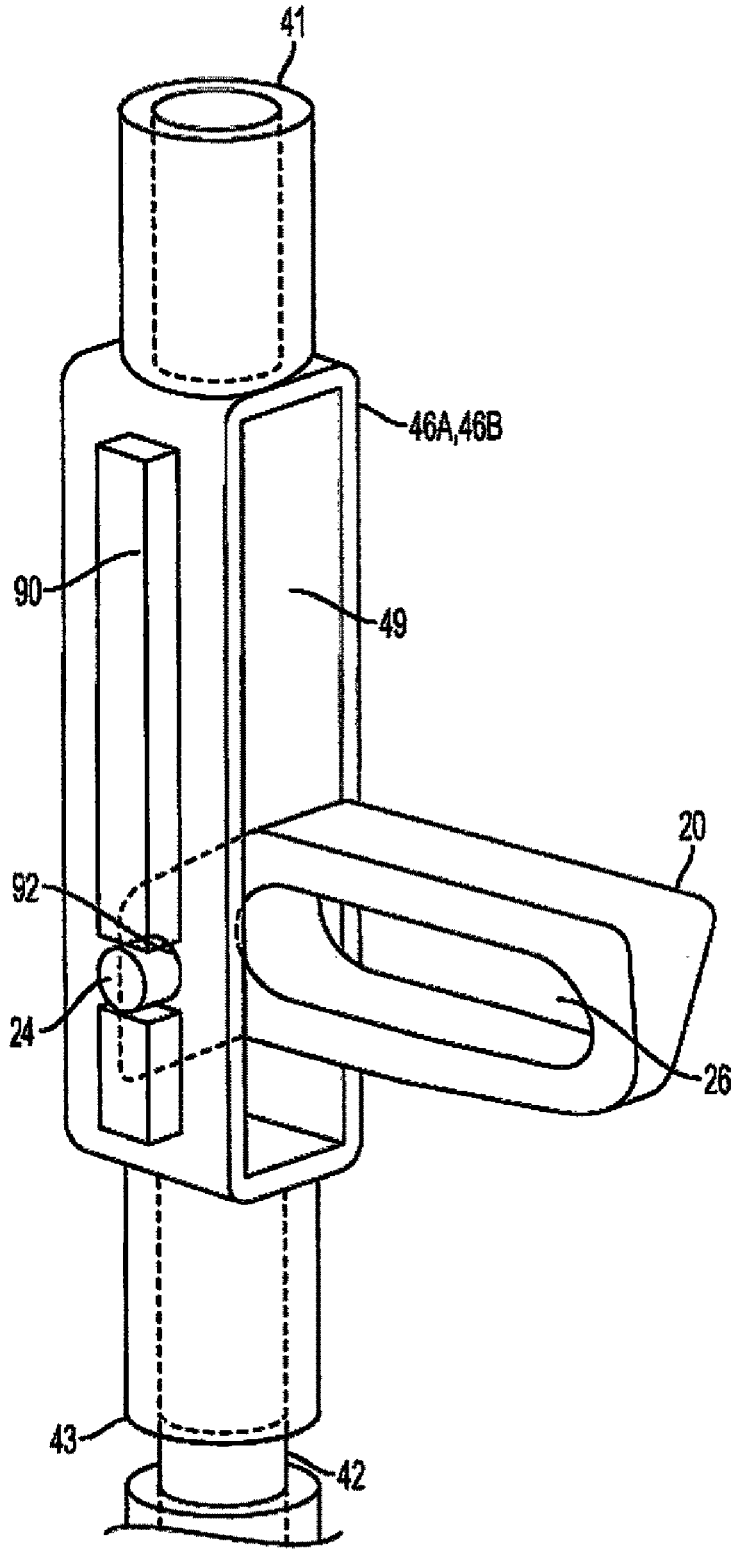
FIG. 7 is a perspective view of one embodiment of a latch bolt slide portion of the latching mechanism shown in FIGS. 2-6B.

One embodiment of an interchangeable upper or lower slide 46A, 46B is shown in FIG. 7. In this embodiment, the slide 46A, 46B can include first and second internally threaded ends 41, 43 configured to receive the threaded ends of connecting rods 42A, 42B. An elongated slot 49 can extend through the slide between the two ends 41, 43. The slot 49 can be configured to receive a latch bolt 20. The latch bolt 20 can be pivotally mounted in the slot 49 by a cross pin 22 that may extend through a cross bore 92 in the slide 46A, 46B. As shown in FIG. 7, the latch bolt 20 can include an elongated guide slot 26.

Figure 6A:
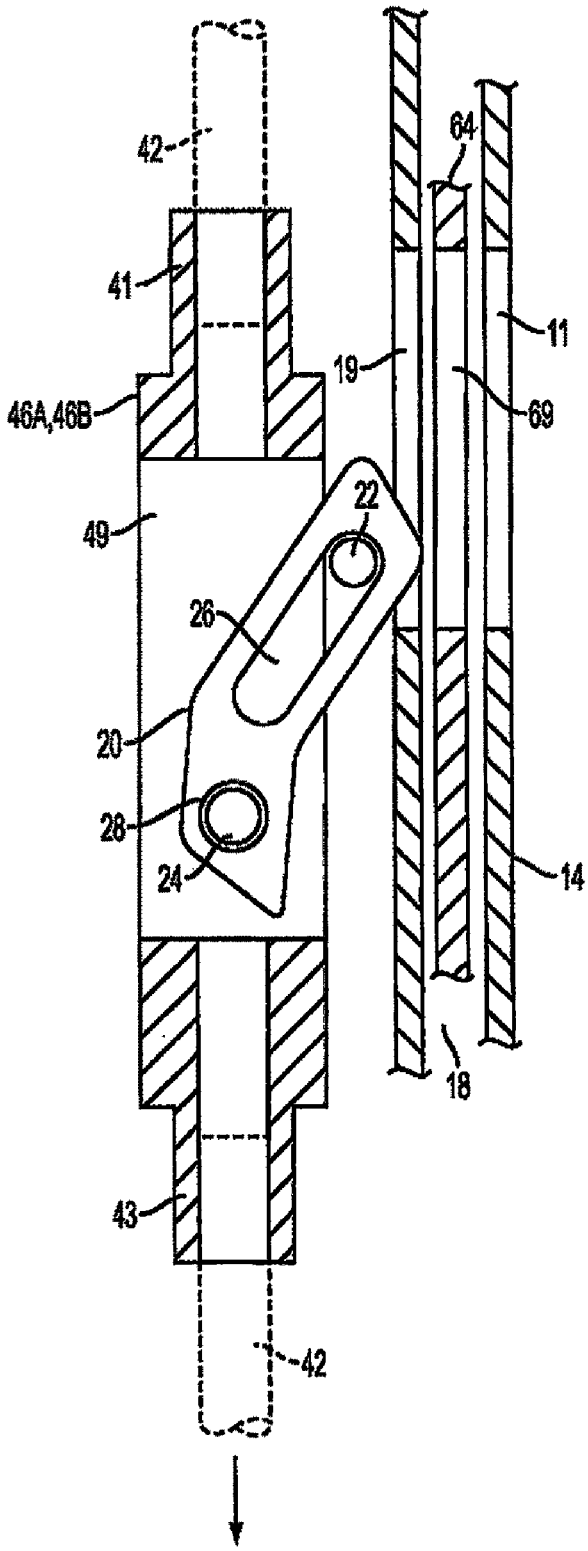
FIG. 6A is a cross-sectional view of a portion of the portion of the multi-point locking system shown in FIG. 5 as taken along section line 6-6 in FIG. 5, with the latching mechanism in an unlocked position.
Figure 6B:
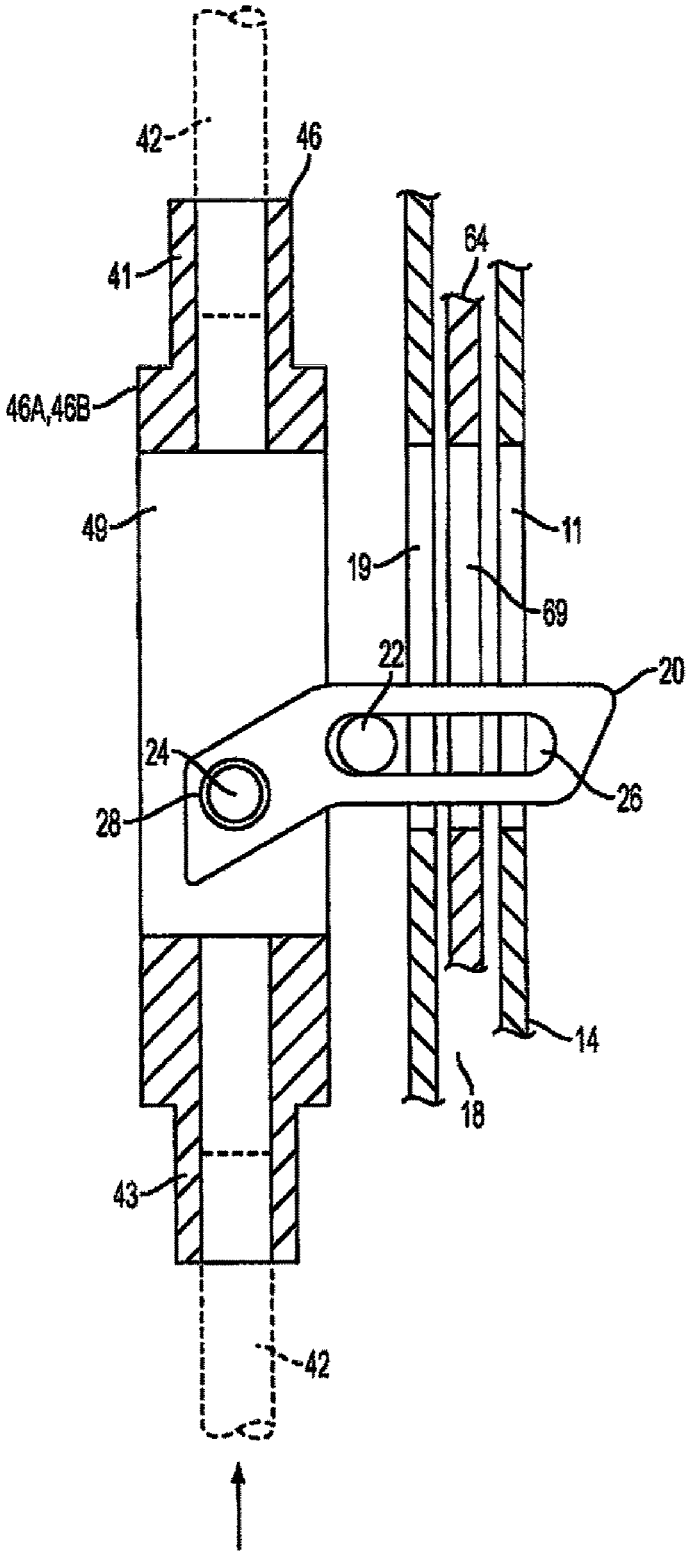
FIG. 6B is a cross-sectional view like that of FIG. 6A with the latching mechanism in a locked position.

As shown in FIG. 5, the upper and lower slides 46A, 46B can be slidably disposed between the opposed elongated channels 53 in the base 14. In the embodiment shown, outwardly extending keys 51 on the slide bearings 50 on the slides 46A, 46B are received in the opposed channels 53. As shown in FIGS. 5-6B, the slot 49 and latch bolt 20 can substantially align with one of the apertures 69 in the latch member 64 of the inactive locking astragal 60, and with a first opening 19 and an opposed second opening 11 along the channel 18 in the base 14. A guide pin 22 can be fixed to the base 14, and extend through the slot 26 in the latch bolt 20. As shown in FIG. 6A, when the slide 46A, 46B is positioned at a lowermost position in the base 14 (by the downward movement of a connecting rod 42), the cross pin 24 and guide pin 22 can cooperate to cause the latch bolt 20 to upwardly and inwardly rotate in the slot 49. In this unlocked orientation, substantially no portion of the latch bolt 20 outwardly protrudes from the first opening 19 of the base 14, and substantially no portion of the latch bolt 20 extends across the channel 18. Accordingly, in this unlocked position, the latch bolt 20 does not restrict receipt or withdrawal of the latch member 64 of the inactive locking astragal 60 into or out of the channel 18.

FIGS. 5 and 6B show the slide 46A, 46B in an uppermost, locked position in the base 14. In this position, the cross pin 24 and guide pin 22 can cooperate to cause the latch bolt 20 to downwardly and outwardly rotate in the slot 49 of the slide 46A, 46B. In this locked orientation, a substantial portion of the latch bolt 20 outwardly protrudes from the first opening 19 of the base 14, and extends across the channel 18, through an aperture 69 in the latching member of the inactive locking astragal 60, and through the second opening in the base 14. Accordingly, in this locked position, the latch bolt 20 blocks withdrawal of the engaged latch member 64 of the inactive locking astragal 60 from the channel 18, and thereby substantially prevents any swinging movement of the active door panel 100 relative to the fixed inactive door panel 200.

Figure 8:
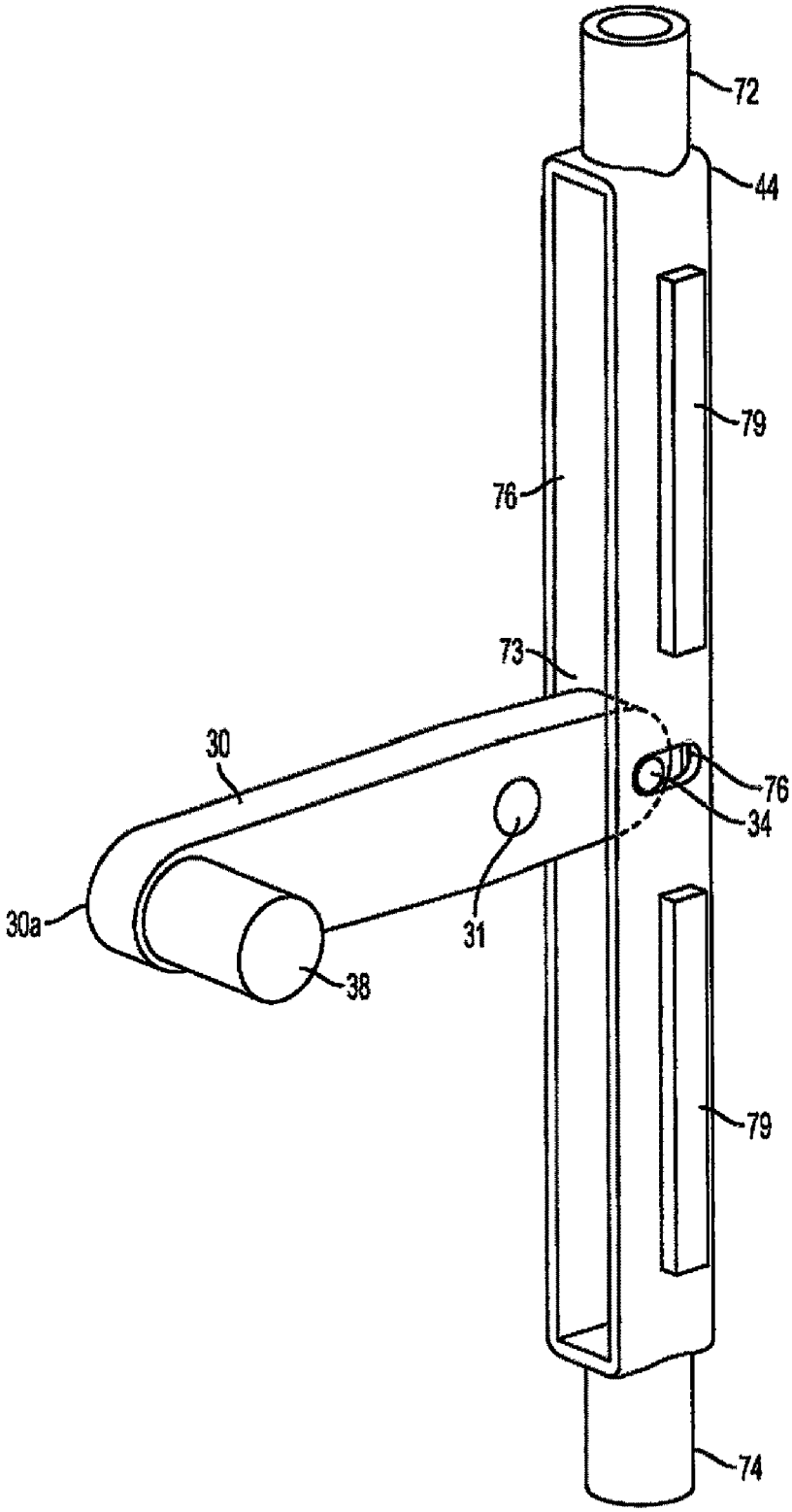
FIG. 8 is a perspective view of one embodiment of an actuator slide portion of the latching mechanism shown in FIGS. 2-6B.

One embodiment of an actuator slide 44 is shown in FIG. 8. In this embodiment, the actuator slide 44 can include first and second internally threaded ends 72, 74 for receiving mating threaded ends of connecting rods 42A, 42B. A slot 73 can be configured to receive an end of the actuator lever 30. A cross pin 34 can extend through the lever 30, and can be received in elongated holes 76 (one shown) in opposed sides of the slot 73. The actuator lever 30 also can include a cross bore 31, and may include a knob 38 on its free end 30*a*. As shown in FIG. 2, a fulcrum pin 39 can extend through the cross bore 31, and pivotally connect the lever 30 to the base 14. The free end 30*a* of the lever 30 outwardly extends from the base 14 and cover 16 through aligned windows 36A, 36B. Like the upper and lower latch bolt slides 46A, 46B described above, the actuator slide 44 can be slidably disposed in and between the opposed elongated channels 53 in the base 14. Also, like the upper and lower latch bolt slides 46A, 46B, the actuator slide 44 can include slide bearings 50 to facilitate sliding movement of the slide 44 in and along the mating channels 53 in the base 14. As the free end 30*a* of the actuator lever 30 is lowered, the lever 30 pivots about fulcrum pin 39, and causes the actuator slide 44 to slide upwardly in the base 14. Conversely, upward movement of the free end 30*a* of the lever 30 causes the actuator slide 44 to slide downwardly in the base 14. As described above, the upper and lower latch bolt slides 46A, 46B can be respectively connected to the actuator slider 44 by upper and lower connecting rods 42A, 42B. Accordingly, the latch bolt slides 46A, 46B and actuator slide 44 can move in unison in the base 14. Thus, lowering the free end 30*a* of the actuator lever 30 causes the actuator slide 44 and both the upper and lower latch bolt slides 46A, 46B to slide upwardly in the base 14. Conversely, upward movement of the free end 30*a* of the lever 30 causes the actuator slide 44 and both the upper and lower latch bolt slides 46A, 46B to slide downwardly in the base 14. Therefore, upward movement of the free end 30*a* of the lever 30 moves the latch bolt slides 46A, 46B into an unlocked position like that shown in FIG. 6A, and downward movement of the free end 30*a* of the lever 30 moves the latch bolt slides 46A, 46B into a locked position like that shown in FIG. 6B. In their locked positions, the upper and lower latch bolts 20 engage the apertures 69 in the latch member 64 of the inactive locking astragal 60, and provide secure, multi-point engagement between the inactive door panel 200 and the active door panel 100.

Figure 9A:
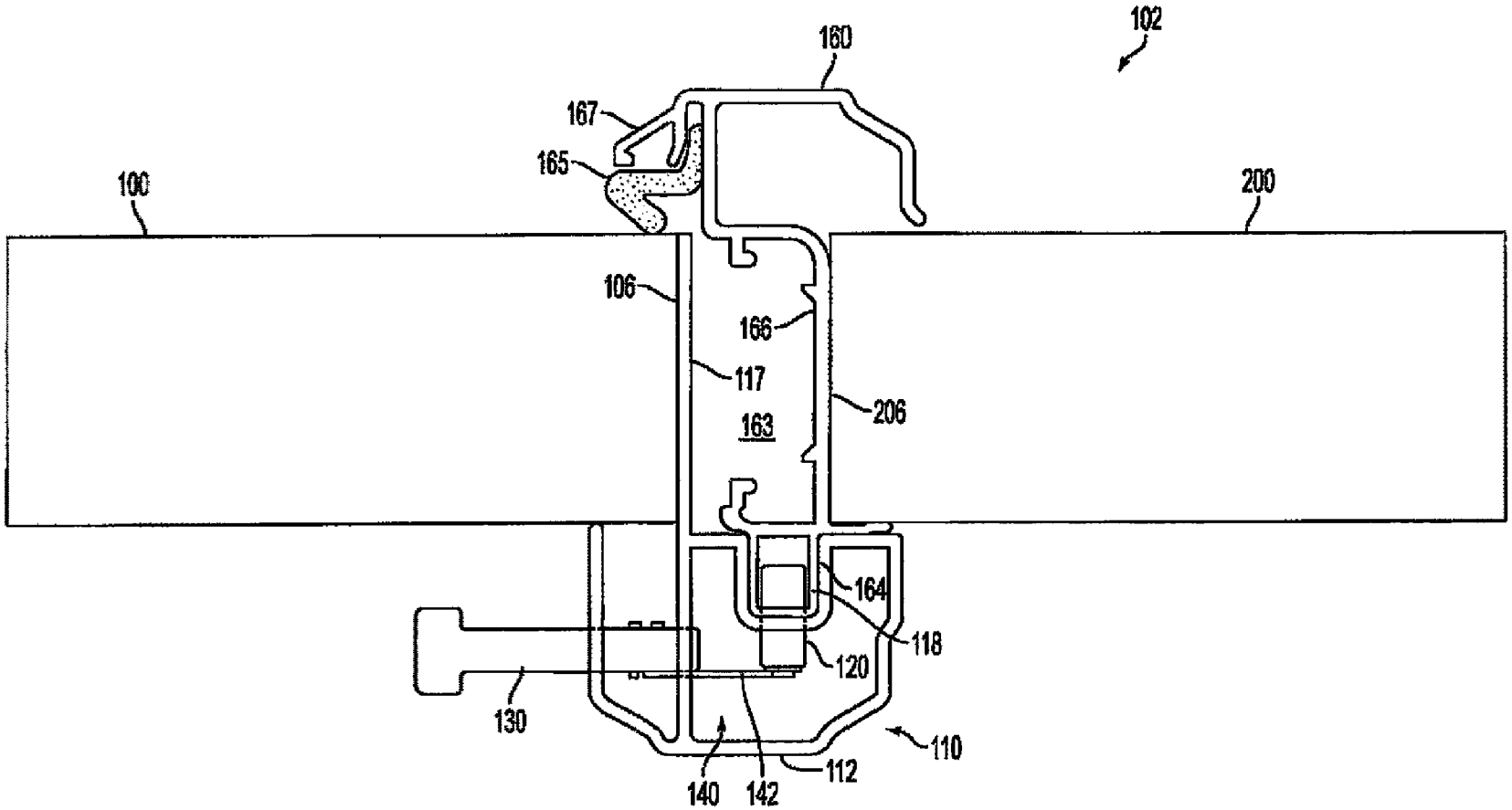
FIG. 9A is a plan cross-sectional view of a second embodiment of a multi-point locking system according to the invention for an inswing double-door entryway.
Figure 9B:
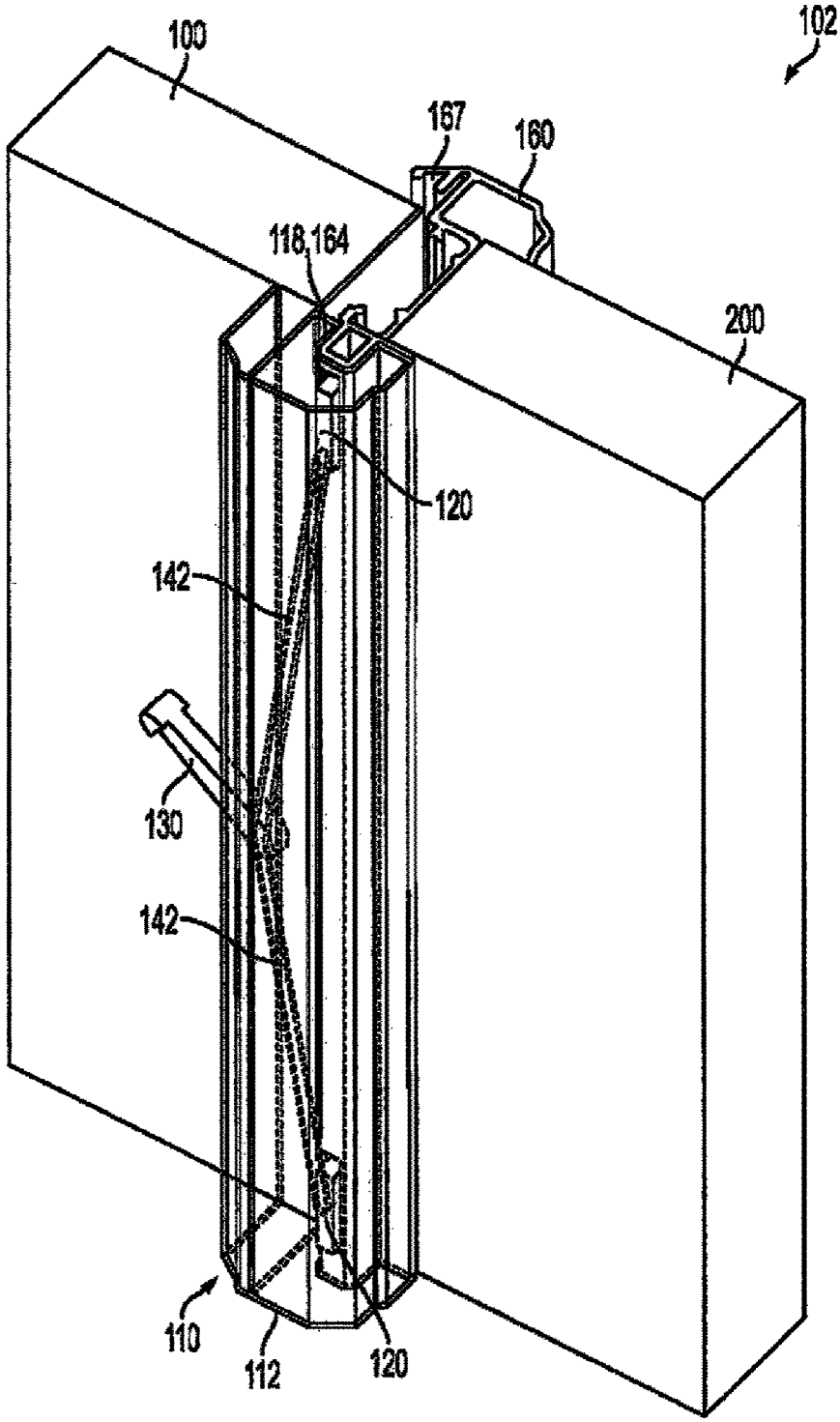
FIG. 9B is a perspective view of a portion of the multi-point locking system shown in FIG. 9A.

Additional embodiments of a multipoint locking system according to the invention for both inswing and outswing double door sets are shown in FIGS. 9A-14B. FIGS. 9A and 9B show another embodiment of a multipoint locking system 102 for an inswing double door. In this embodiment, an inactive locking astragal 160 can include a mounting plate 166 configured to be surface mounted to the planar non-hinged vertical edge 206 of inactive door panel 200. An internal cavity 163 in the inactive astragal 160 can be configured to receive a flush bolt latching mechanism like that described above (not shown). A stop 167 and resilient weather-strip 165 can limit outward movement of the inswing active door panel 100 when closed. An elongated latching member 164 can outwardly extend from the locking astragal 160 along its length. An active multi-point locking astragal 110 can include a mounting plate 117 configured to be surface mounted along the non-hinged vertical edge 106 of the active door panel 100. The active multi-point locking astragal 110 also can include a housing portion 112 that encloses and supports a multi-point latching mechanism 140. The mechanism 140 can include at least two vertically spaced latch bolts 120 movably disposed in the housing 112. In the locked position shown in FIGS. 9A and 9B, the latch bolts 120 extend into a channel 118 in the housing 112, and engage aligned apertures in the latching member 164 of the inactive locking astragal 160 received in the channel 118. In this embodiment, the latch bolts 120 can include hook portions 122 (see FIGS. 15A and 15B) that selectively engage respective edges of apertures in the latching member 164, thereby preventing relative movement between the latched door panels 100, 200. The latch bolts 120 can be selectively pivoted between a retracted, unlocked position (shown in FIG. 15A) and an extended, locked position (shown in FIGS. 9A and 15B) by an actuator lever 130. As shown in FIG. 9B, the actuator lever 130 can be operably connected to the pivoting upper and lower latch bolts 120 by connectors 142. In this embodiment 102, the pivoting motion of the latching bolts 120 and the pivoting motion of the actuator lever 130 occur in different, perpendicular planes.

Figure 10A:
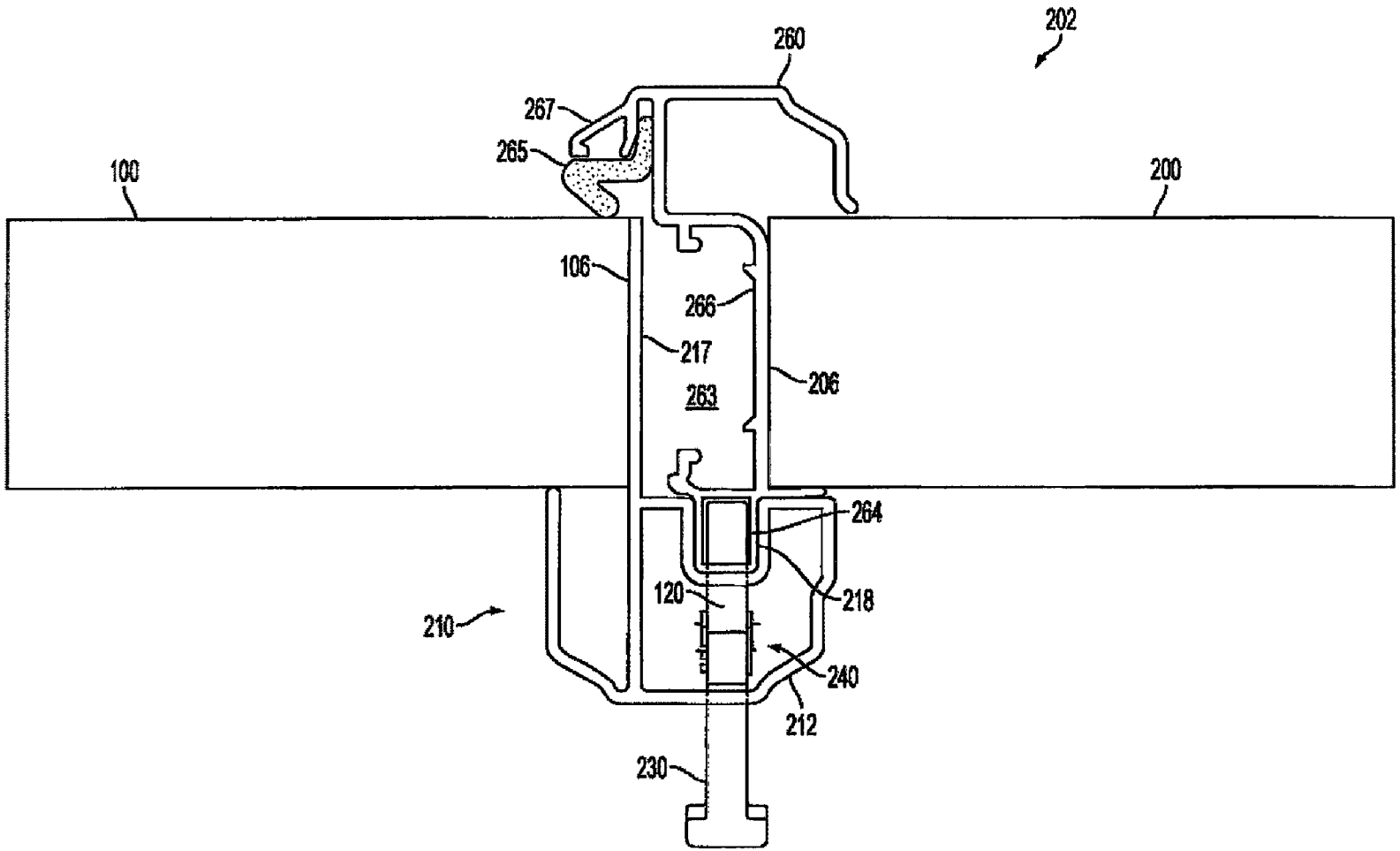
FIG. 10A is a plan cross-sectional view of a third embodiment of a multi-point locking system according to the invention for an inswing double-door entryway.
Figure 10B:
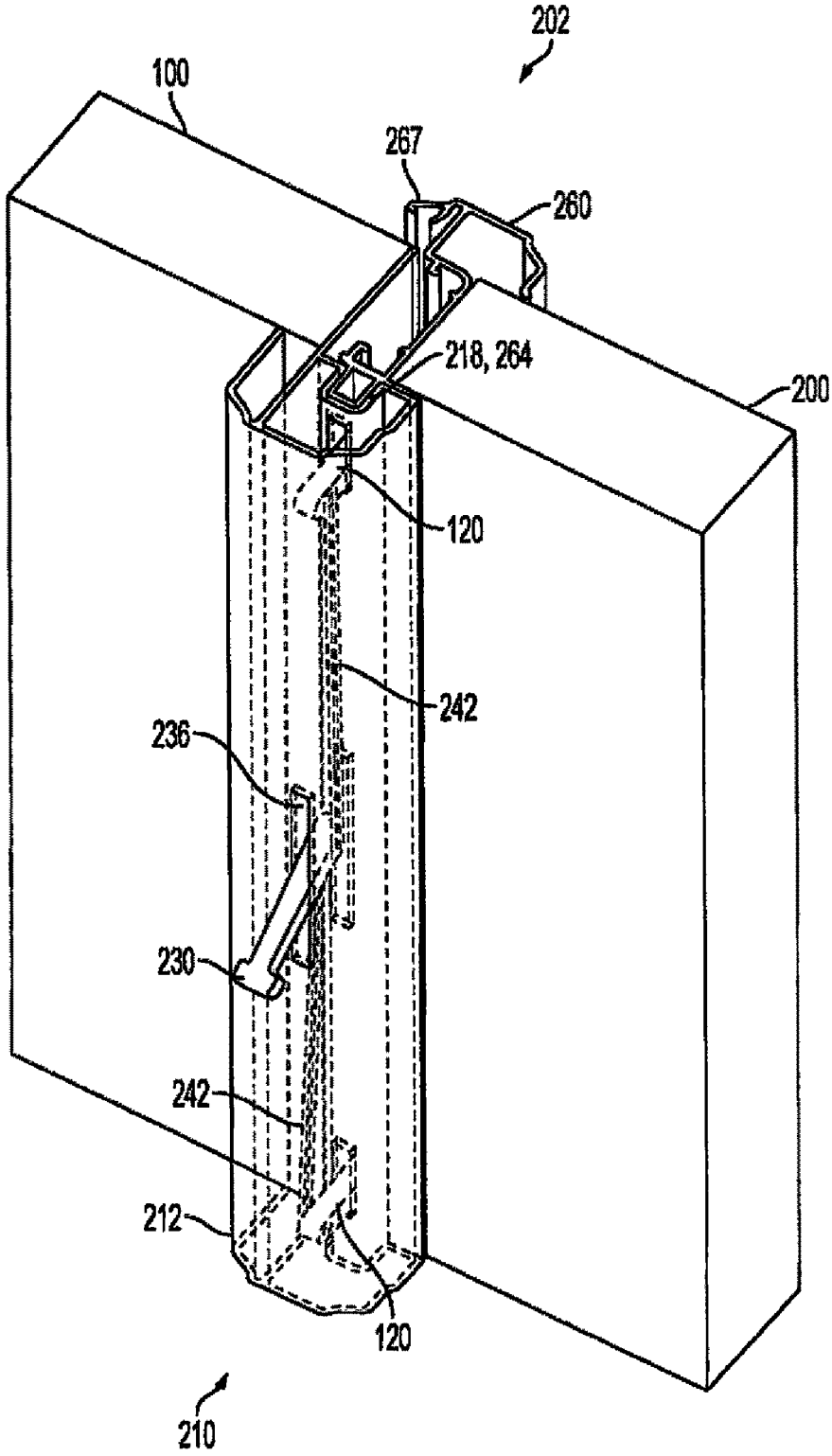
FIG. 10B is a perspective view of a portion of the multi-point locking system shown in FIG. 10A.

FIGS. 10A and 10B show another embodiment of a multipoint locking system 202 for an inswing double door. Like the embodiment 102 described above, an inactive locking astragal 260 can include a mounting plate 266, an internal cavity 263, a stop 267, a resilient weather strip 265, and an elongated latching member 264. An active multi-point locking astragal 210 can include a mounting plate 217 configured for external attachment to one or more outer surfaces along the non-hinged vertical edge 106 of the active door panel 100. The active multi-point locking astragal 110 also can include a housing portion 212 that contains a multi-point latching mechanism 240. The mechanism 240 can include at least two vertically spaced latch bolts 120 pivotally disposed in the housing 212. In the locked position shown in FIGS. 10A and 10B, the latch bolts 120 extend into a channel 218 in the housing 212, and engage aligned apertures (not shown) in the latching member 264 of the inactive locking astragal 260 received in the channel 218. In this embodiment, the latch bolts 120 can include hook portions 122 (see FIGS. 15A and 15B) that grab edges of the apertures in the latching member 264, and thereby prevent relative movement between the latched door panels 100, 200. The latch bolts 120 can be selectively moved between the locked position shown in FIGS. 10A, 10B, and 15B, and a retracted unlocked position (shown in FIG. 15A) by an actuator lever 230. The actuator lever 230 can be operably connected to the pivoting upper and lower latch bolts 120 by connectors 242. In this embodiment 202, the pivoting motion of the latching bolts 120 and the pivoting motion of the actuator lever 230 occur in a common plane that is perpendicular to the door panels 100, 200.

Figure 11A:
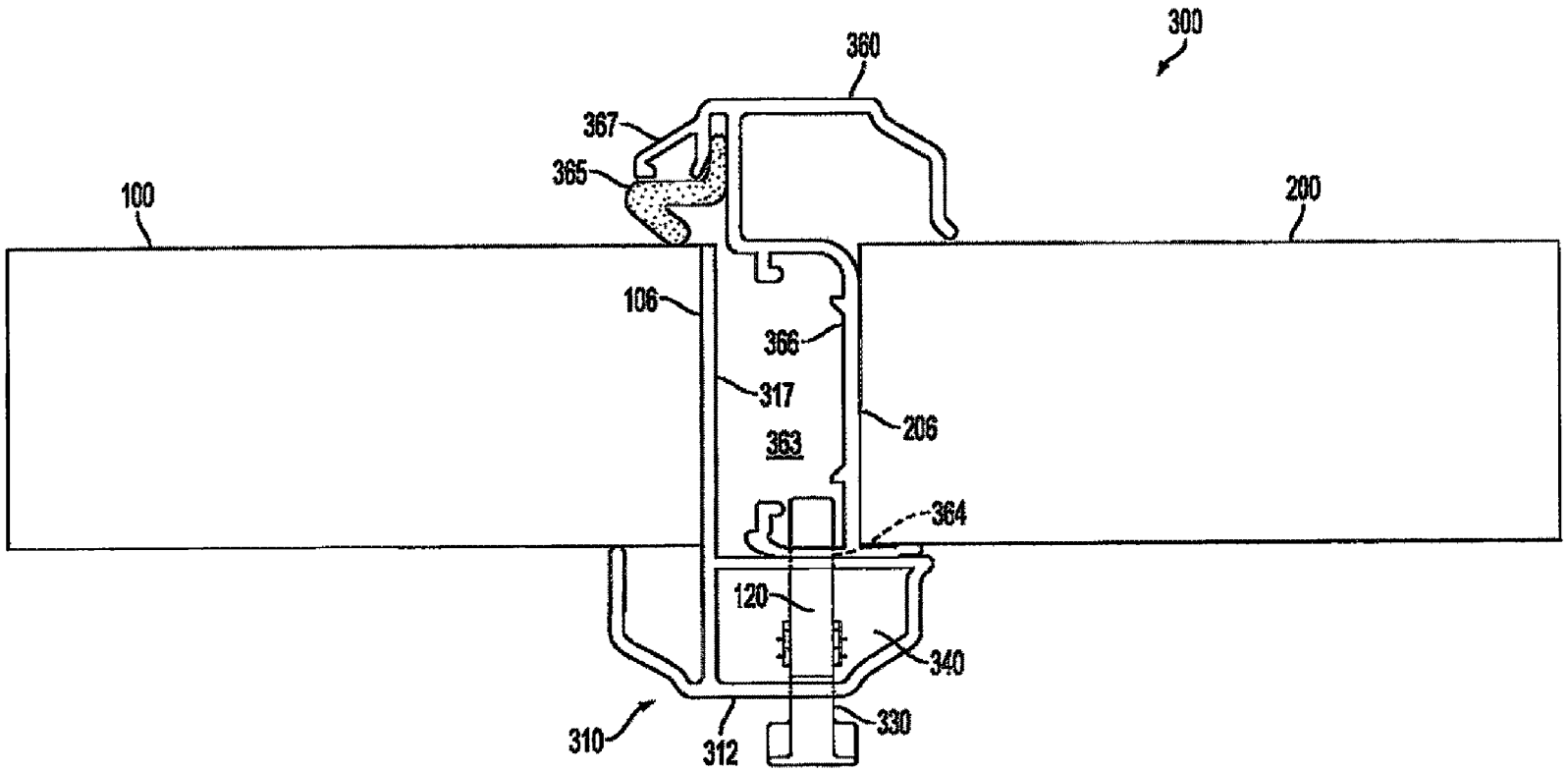
FIG. 11A is a plan cross-sectional view of a fourth embodiment of a multi-point locking system according to the invention for an inswing double-door entryway.
Figure 11B:
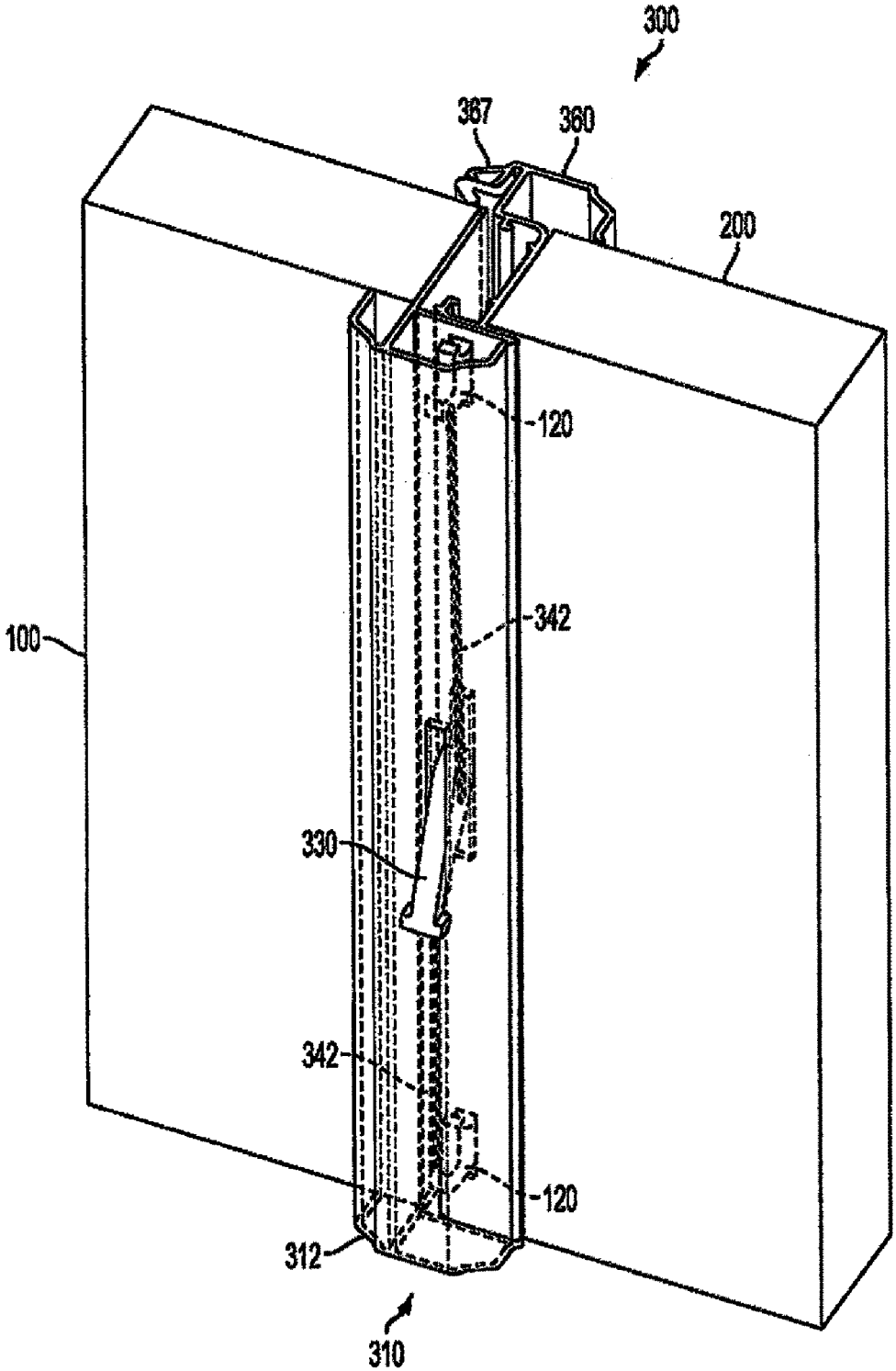
FIG. 11B is a perspective view of a portion of the multi-point locking system shown in FIG. 11A.

Another embodiment of a multipoint locking system 300 for an inswing double door set is shown in FIGS. 11A and 11B. In this embodiment, an inactive locking astragal 360 can include a mounting plate 366 that can be externally mounted to one or more outer surfaces along the non-hinged vertical edge 206 of inactive door panel 200. An internal cavity 363 in the inactive astragal 360 can be configured to receive a flush bolt latching mechanism like that described above (not shown). A stop 367 and resilient weather-strip 365 can limit outward movement of the inswing active door panel 100. In this embodiment, the latching member 364 is parallel to the inside faces of the closed door panels 100, 200. An active multi-point locking astragal 310 can include a mounting plate 317 configured to be surface mounted along the non-hinged vertical edge 106 of the active door panel 100, and a housing 312 that encloses and supports a multi-point latching mechanism 340. The mechanism 340 can include at least two vertically spaced latch bolts 120 pivotally disposed in the housing 312. In the locked position shown in FIGS. 11A, 11B, and 15B, the latch bolts 120 outwardly protrude through aligned openings in the housing 312, and engage aligned apertures in the latching member 364 of the inactive locking astragal 360. In this embodiment, the latch bolts 120 can include hook portions 122 (see FIGS. 15A and 15B) that selectively grab edges of the apertures in the latching member 364, and thereby prevent relative movement between the latched door panels 100, 200. The latch bolts 120 can be selectively moved between the locked position shown in FIGS. 11A, 11B, and 15B, and a retracted, unlocked position (see FIG. 15A) by an actuator lever 330. The actuator lever 330 can be operably connected to the upper and lower latch bolts 120 by connectors 342. In this embodiment 300, the motion of the latching bolts 120 and the pivoting motion of the actuator lever 330 occur in a common plane.

Figure 12A:
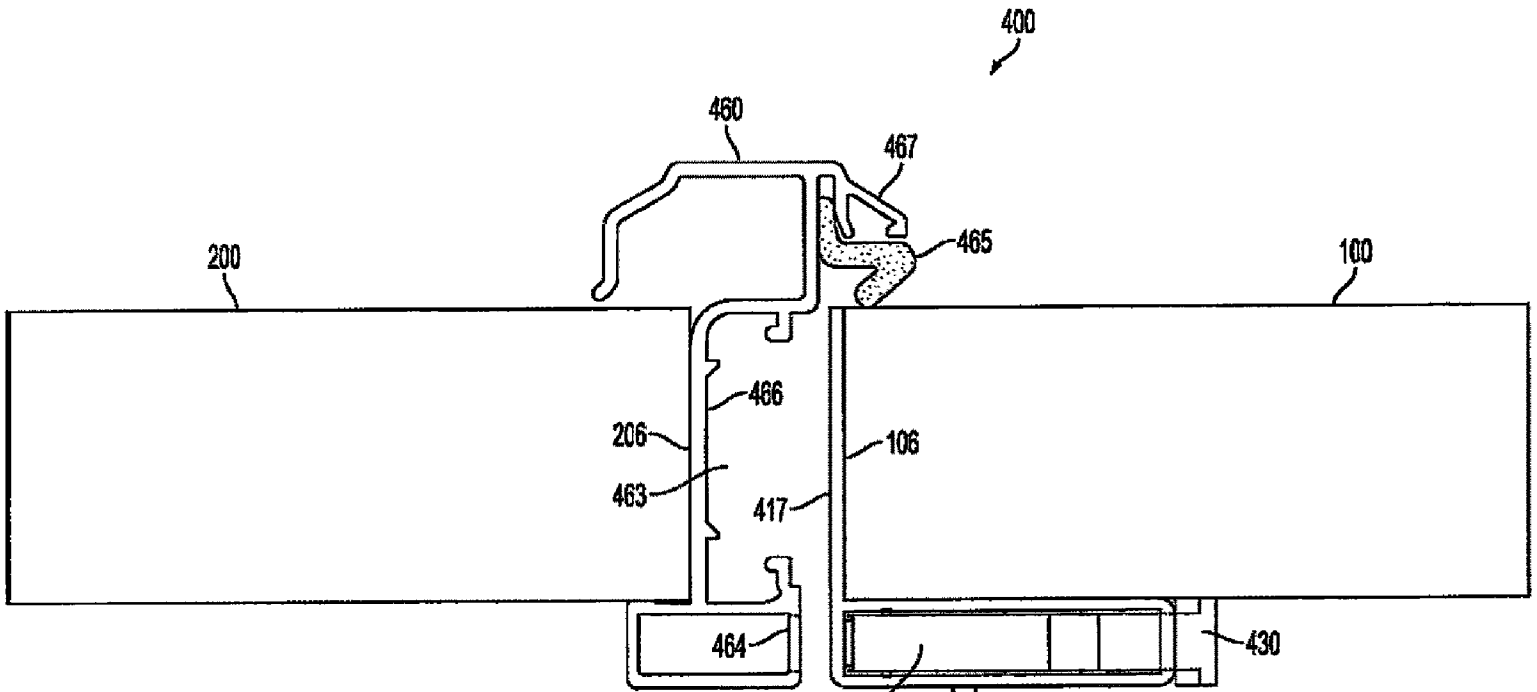
FIG. 12A is a plan cross-sectional view of a fifth embodiment of a multi-point locking system according to the invention for an inswing double-door entryway.
Figure 12B:
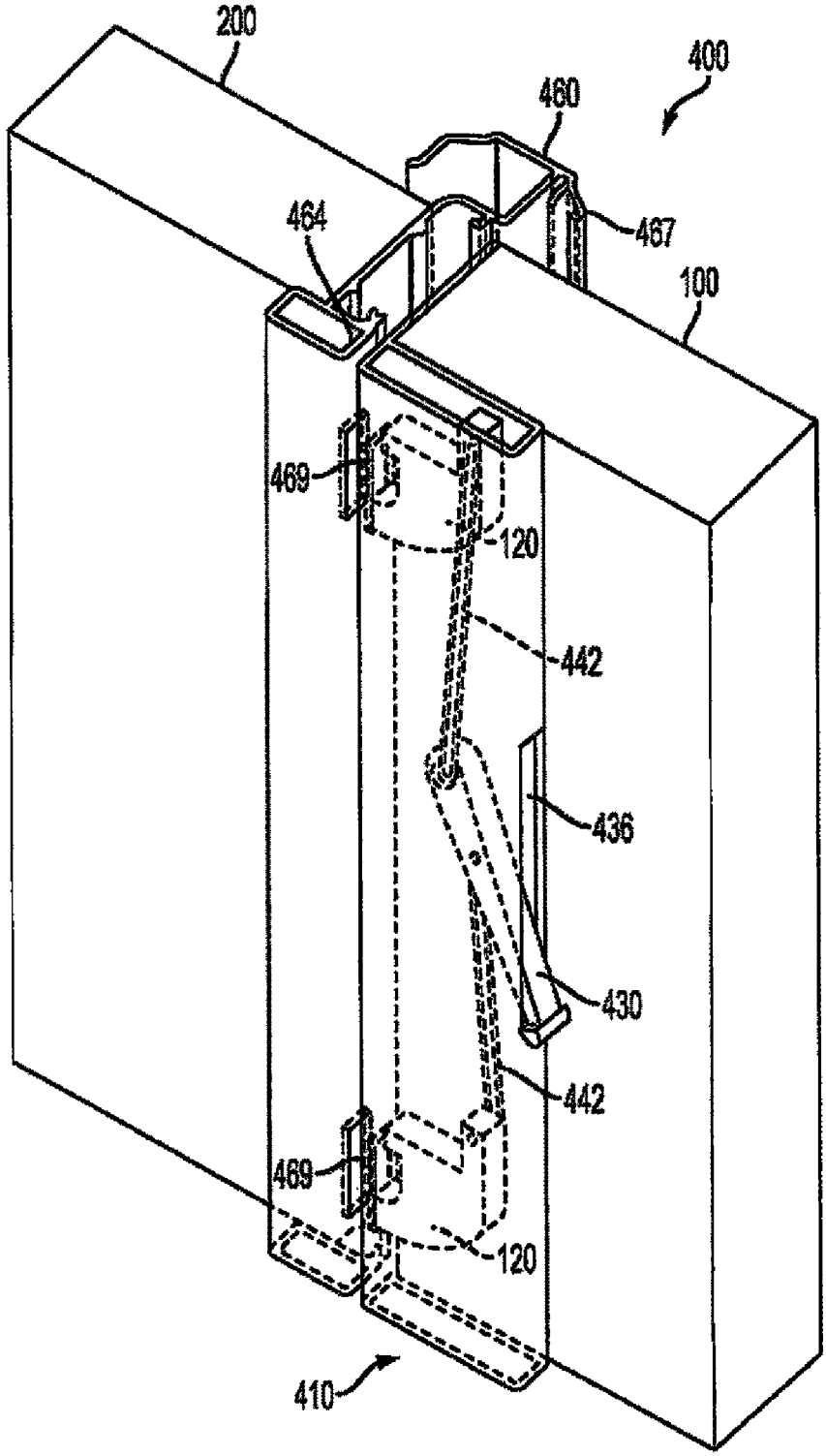
FIG. 12B is a perspective view of a portion of the multi-point locking system shown in FIG. 12A.

A further embodiment of a multipoint locking system 400 for an inswing double door set is shown in FIGS. 12A and 12B. In this embodiment, an inactive locking astragal 460 can include a mounting plate 466 configured to be surface mounted to the non-hinged vertical edge 206 of an inactive door panel 200. An internal cavity 463 in the inactive astragal 460 can be configured to receive a flush bolt latching mechanism like that described above (not shown). A stop 467 and resilient weather-strip 465 can limit outward movement of the inswing active door panel 100. In this embodiment, the latching member 464 is perpendicular to the inside faces of the closed door panels 100, 200. An active multi-point locking astragal 410 can include a mounting plate 417 configured to be externally mounted on one or more outer surfaces along the non-hinged vertical edge 106 of the active door panel 100, and a housing 412 that encloses and supports a multi-point latching mechanism 440. The mechanism 440 can include at least two vertically spaced latch bolts 120 pivotally disposed in the housing 412. In the locked position shown in FIGS. 12A, 12B, and 15B, the latch bolts 120 outwardly protrude through aligned openings in the housing 412, and engage aligned apertures 469 in the latching member 464 of the inactive locking astragal 460. In this embodiment, the latch bolts 120 may or may not include hook portions 122 configured to grab edges of the apertures of the latching member 464 to prevent relative movement between the latched door panels 100, 200. The latch bolts 120 are selectively moved between the locked position shown in FIGS. 12A, 12B, and 15B, and a retracted, unlocked position (shown in FIG. 15A) by an actuator lever 430. The actuator lever 430 is operably connected to the pivoting upper and lower latch bolts 120 by connectors 442. In this embodiment 400, the motion of the latching bolts 120 and the pivoting motion of the actuator lever 430 occur in a common plane that is parallel to the closed door panels 100, 200.

Figure 13A:
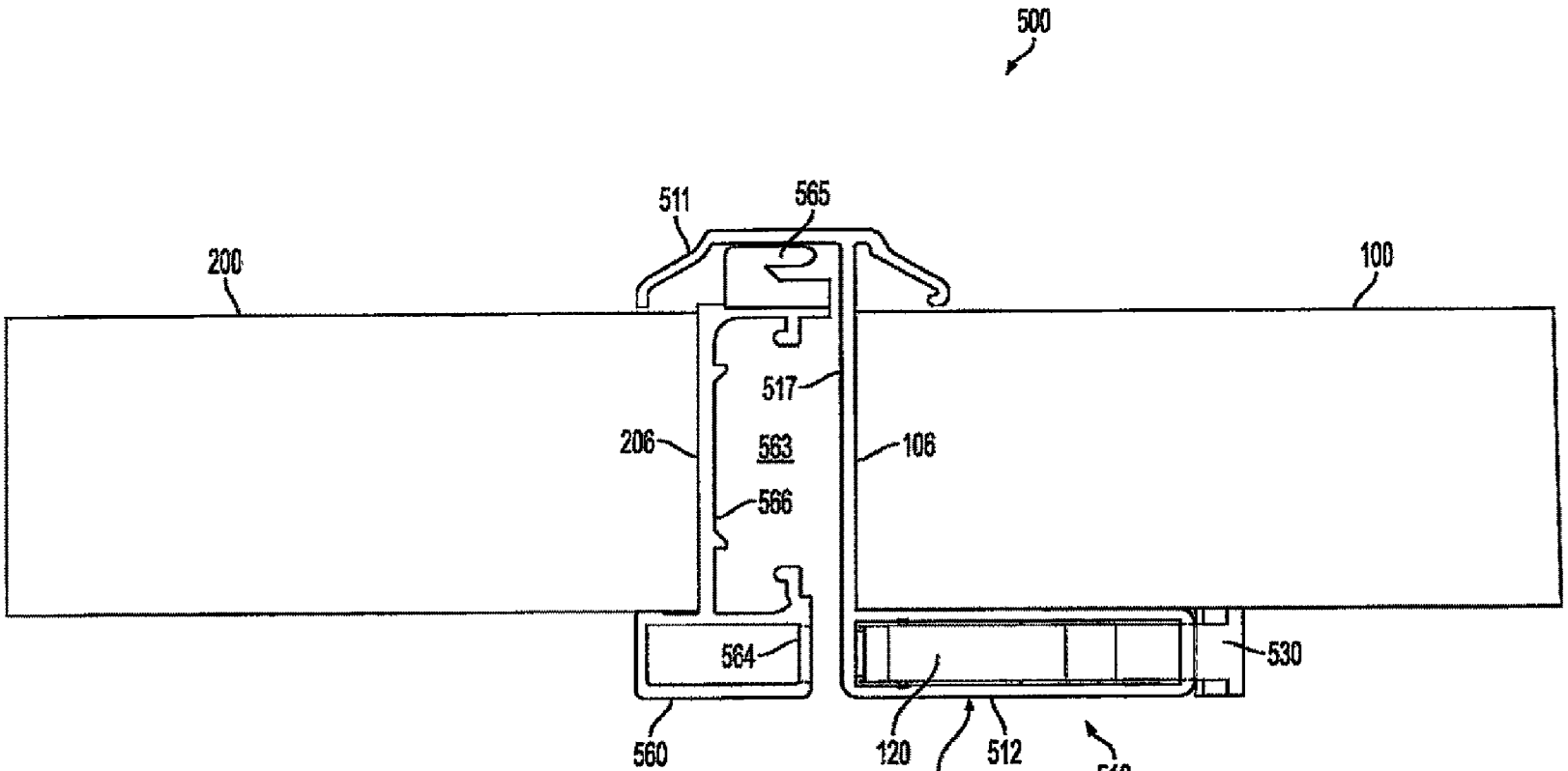
FIG. 13A is a plan cross-sectional view of one embodiment of a multi-point locking system according to the invention for an outswing double-door entryway.
Figure 13B:
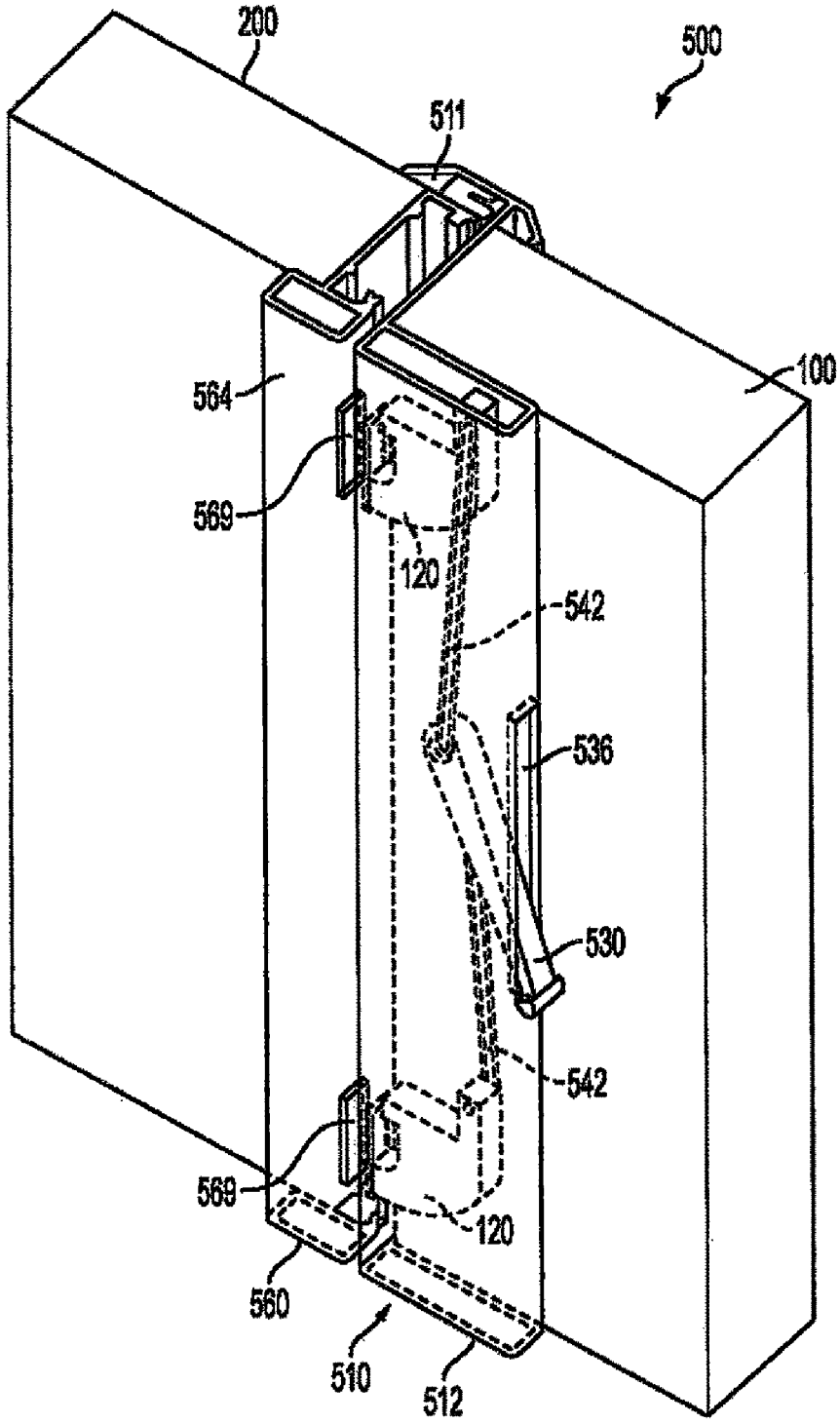
FIG. 13B is a perspective view of a portion of the multi-point locking system shown in FIG. 13A.

FIGS. 13A-14B show two additional embodiments of a multi-point locking system according to the invention. Unlike the embodiments described above, the embodiments shown in FIGS. 13A-14B are adapted for use with outswing double doors, rather than inswing doors. As shown in FIGS. 13A and 13B, an outswing multipoint locking system 500 can include an inactive locking astragal 560, and an active locking astragal 510. The inactive locking astragal 560 can include a mounting plate 566 configured for surface attachment to the non-hinged vertical edge 206 of the inactive door panel 200. An internal cavity 563 in the inactive astragal 560 can be configured to receive a flush bolt latching mechanism like that described above (not shown). In this embodiment, a latching member 564 is perpendicular to the inside faces of the closed door panels 100, 200. An active multi-point locking astragal 510 can include a mounting plate 517 configured for surface attachment to the non-hinged vertical edge 106 of the active door panel 100. The active locking astragal 510 also can include a stop 511 and a resilient weather strip 565 that limit the inward swing of the active door panel 100 when closed. The active locking astragal also can include a housing 512 that encloses and supports a multi-point latching mechanism 540. The mechanism 540 can include at least two vertically spaced latch bolts 120 pivotally disposed in the housing 512. In the unlocked position shown in FIGS. 13A, 13B, and 15B, the latch bolts 120 are contained within the housing 512. In a locked position (not shown), the latch bolts 120 outwardly extend from the housing 512, and engage aligned apertures 569 in the latching member 564 of the inactive locking astragal 560. In this embodiment, the latch bolts 120 may or may not include hook portions 122 that selectively grab edges of the apertures 569 of the latching member 564 to prevent relative movement between the latched door panels 100, 200. The latch bolts 120 can be selectively moved between the unlocked position shown in FIGS. 13A, 13B, and 15A, and an extended locked position (see FIG. 15B) by an actuator lever 530. The actuator lever 530 can be operably connected to the pivoting upper and lower latch bolts 120 by connectors 542. In this embodiment 500, the motion of the latching bolts 120 and the pivoting motion of the actuator lever 530 occur in a common plane that is parallel to the closed door panels 100, 200.

Figure 14A:
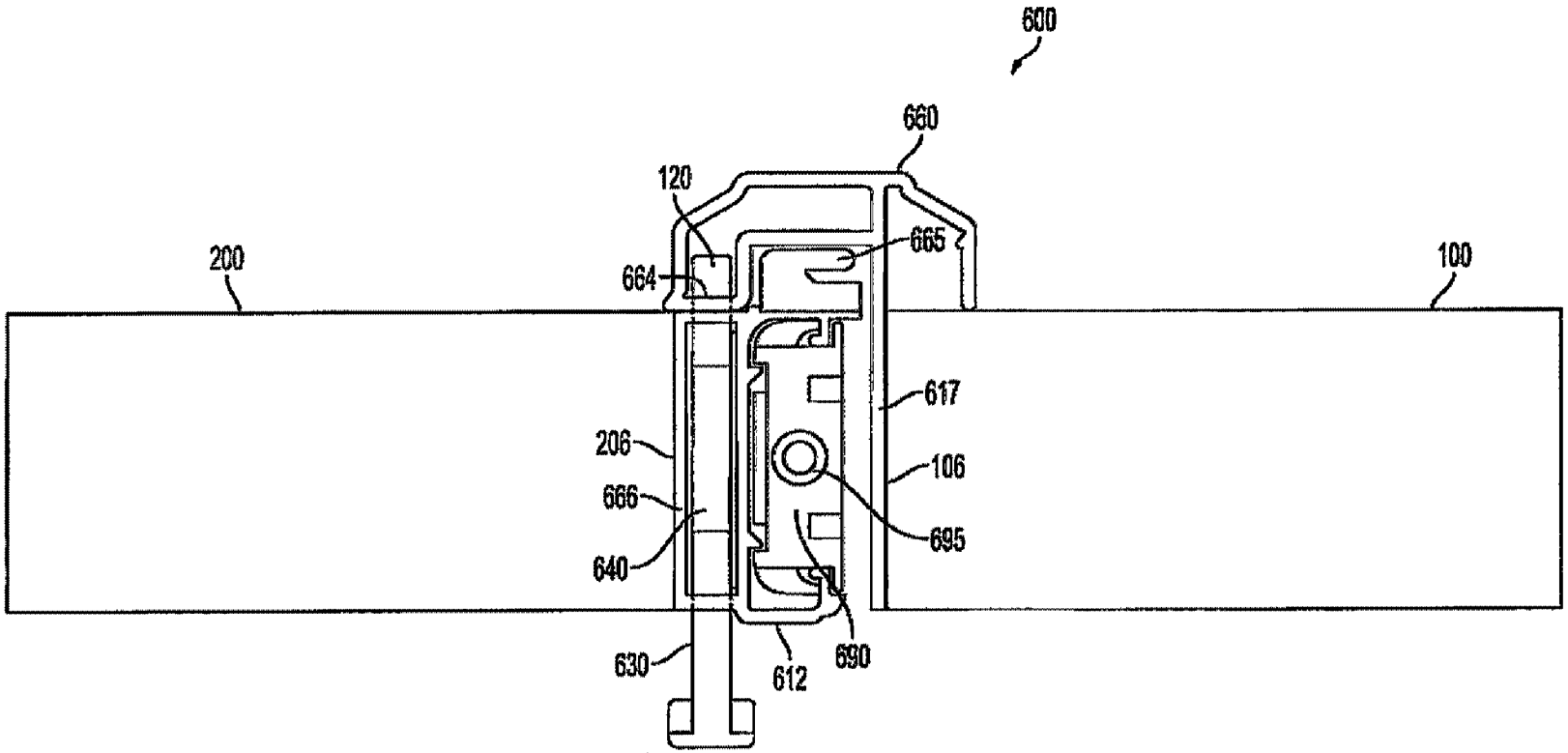
FIG. 14A is a plan cross-sectional view of a second embodiment of a multi-point locking system according to the invention for an outswing double-door entryway.
Figure 14B:
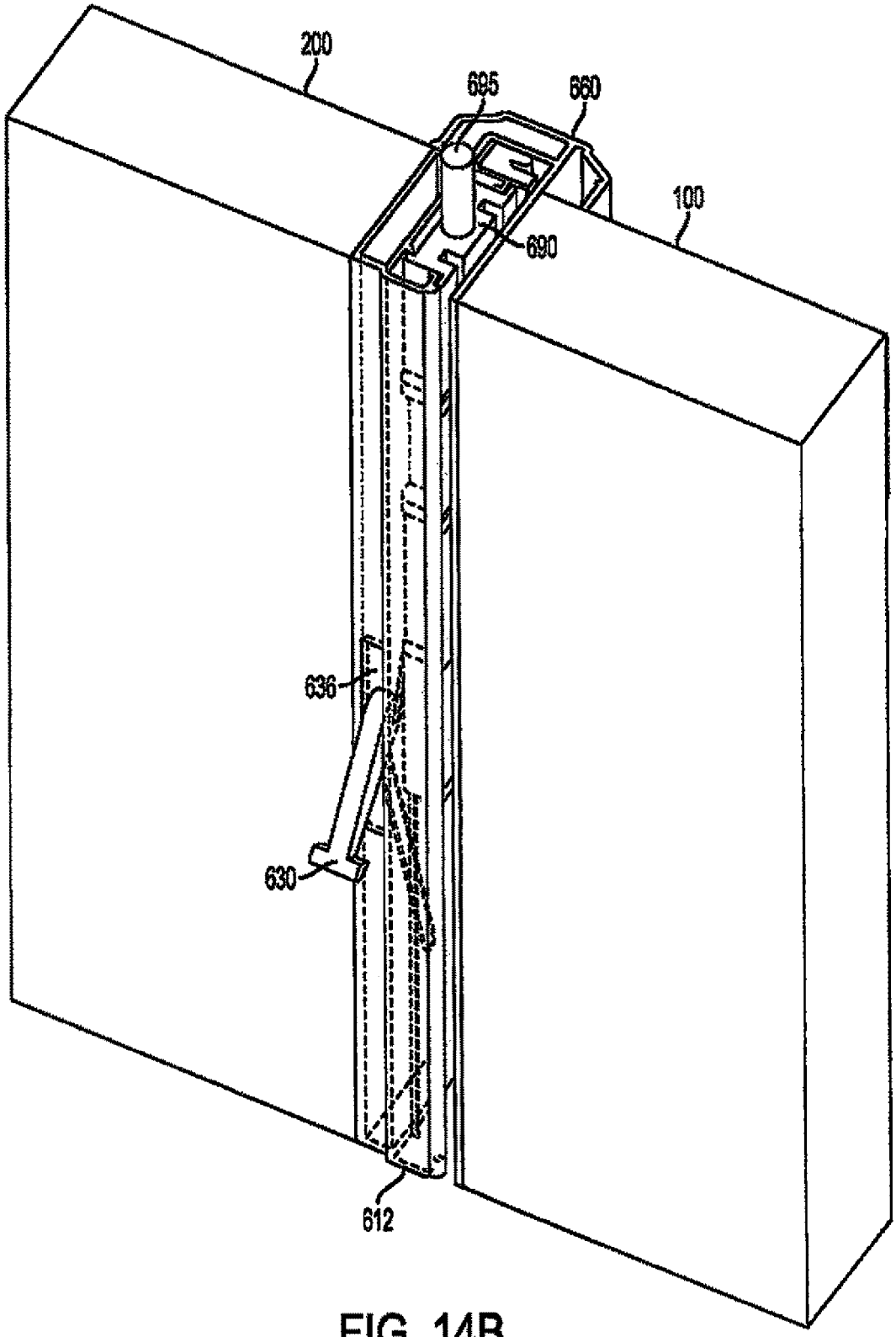
FIG. 14B is a perspective view of a portion of the multi-point locking system shown in FIG. 14A.
Figure 15A:
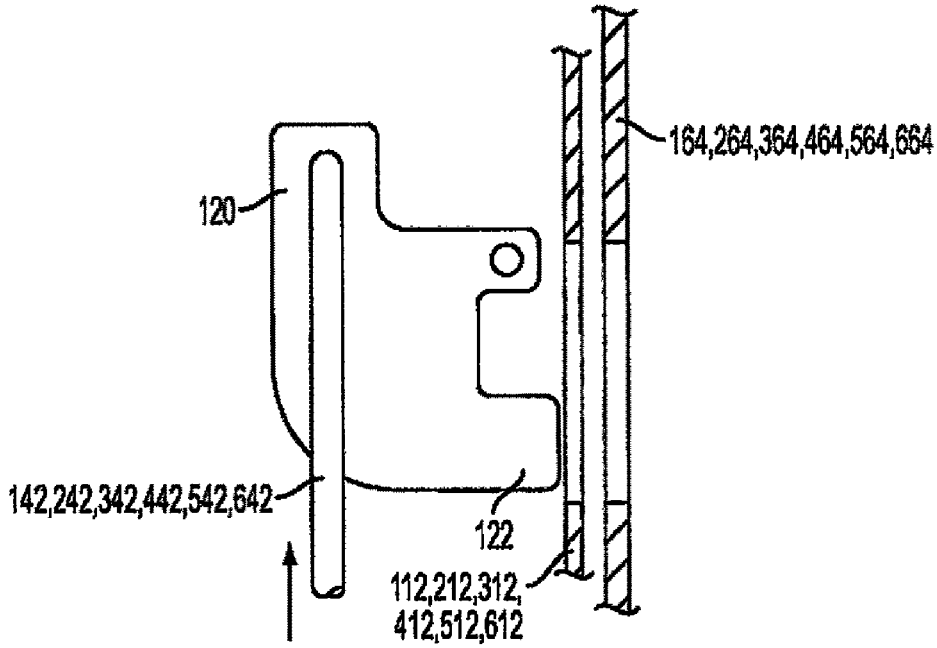
FIG. 15A is a plan view of one embodiment of a pivoting latch bolt for use in the multi-point locking astragals shown in FIGS. 9A-14B, the latch bolt being shown in an unlocked position.
Figure 15B:
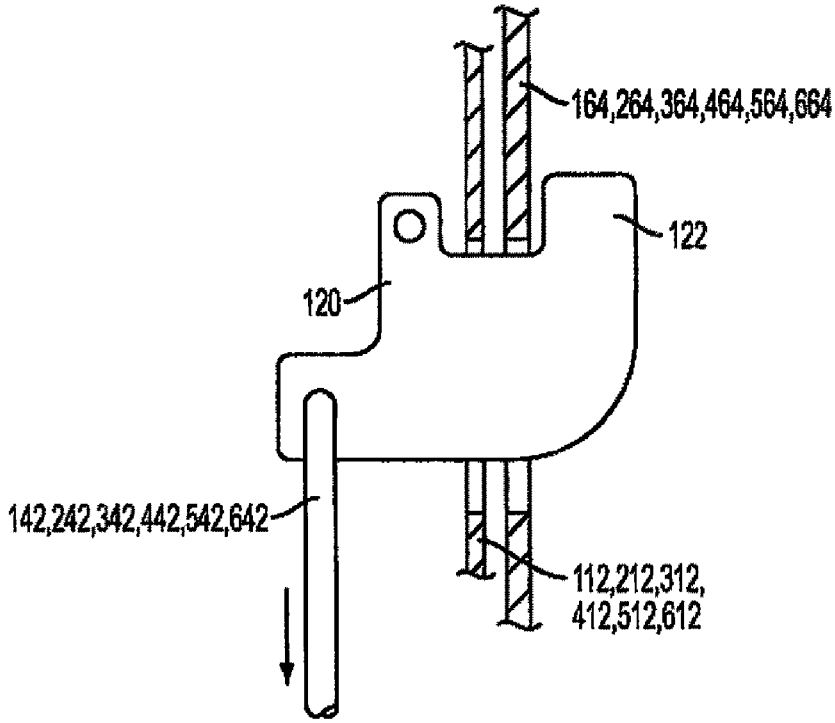
FIG. 15B is a plan view of the pivoting latch bolt shown in FIG. 15A, the latch bolt being shown in a locked position.

FIGS. 14A and 14B show another embodiment of a multi-point locking system 600 for a set of outswing double doors 100, 200. In this embodiment, the inactive locking astragal 610 can include a mounting plate 666 configured for surface attachment to the non-hinged edge of an inactive door panel, and a housing 612. The inactive locking astragal 610 also can include a flush bolt latching mechanism 690 of a type known in the art, as well as a multi-point locking mechanism 640 contained within the housing 612. The multi-point locking mechanism 640 can include at least two vertically spaced latch bolts 120 pivotally disposed in the housing 612. In the locked position shown in FIGS. 14A, 14B, and 15B, the latch bolts 120 outwardly extend through aligned openings in the housing 612. In an unlocked position (see FIG. 15A), the latch bolts 120 are retracted within the housing 612. An active panel astragal 660 can include a mounting plate 617 configured to be surface mounted along the non-hinged vertical edge of the active door panel 100. The active panel astragal 660 also can include a latching member 664 having a plurality of spaced apertures therealong (not shown). When the latch bolts 120 of the inactive locking astragal 610 are extended to their locked positions (see FIG. 15B), the latch bolts 120 are received in the apertures of the latching member 664. The latch bolts 120 include hook portions 122 that selectively grab edges of the apertures in the latching member 664 to prevent relative movement between the latched door panels 100, 200 (see FIGS. 15A and 15B). The multipoint latching mechanism 640 includes an actuator lever 630 that selectively controls movement of the latch bolts 120 between their locked and unlocked positions.

Figure 16:
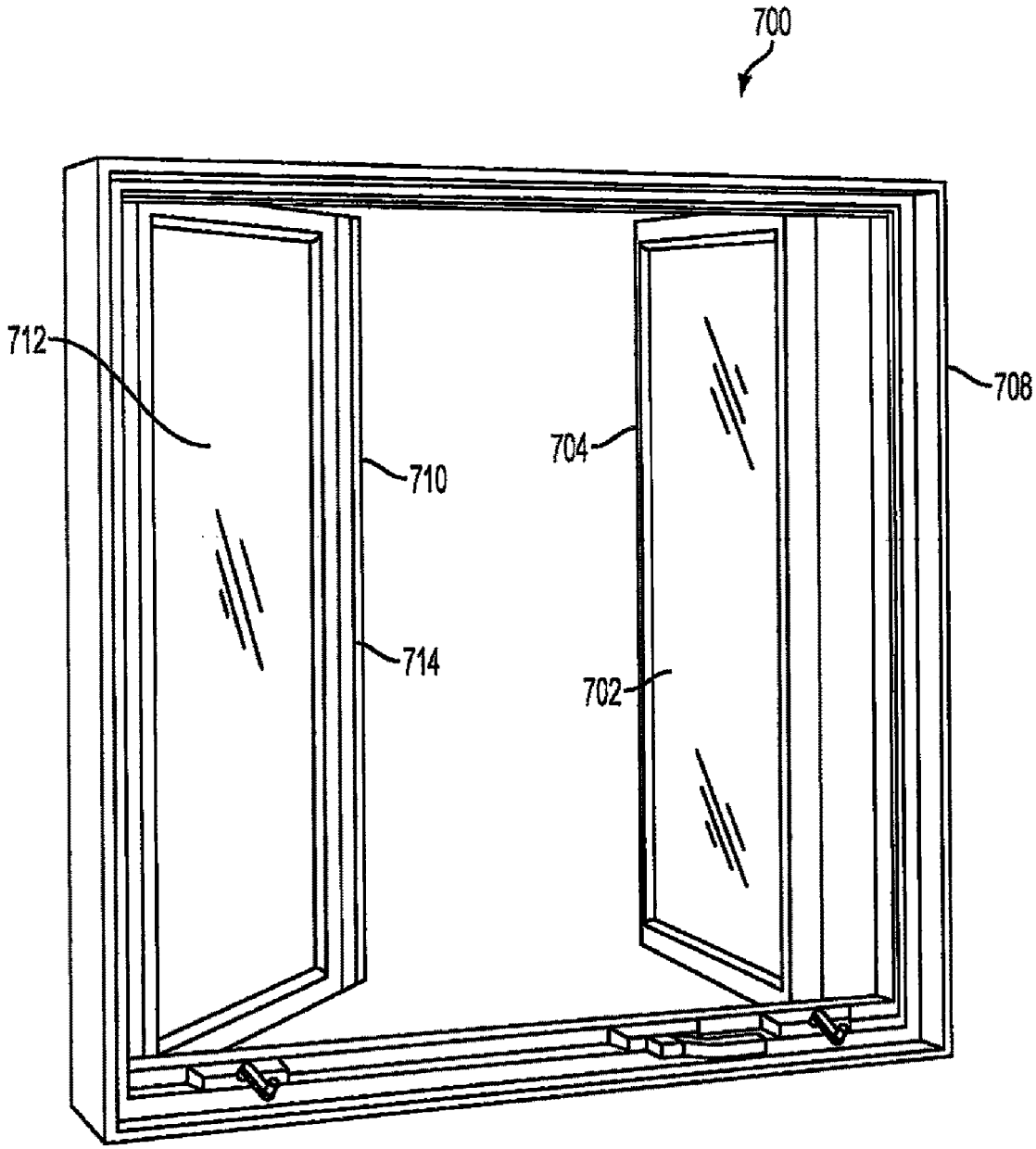
FIG. 16 is a perspective view of a window having double swinging window sashes and a multi-point lock according to the invention.

Though a multi-point lock according to the invention principally has been described in connection with swinging door panels, a multi-point locking device according to the invention also can be used with other types of swinging closure panels. For example, as shown in FIG. 16, a multipoint locking device 710 substantially like one of the embodiments described above can be externally mounted along a non-hinged vertical edge 714 of a swinging window sash panel 712. In the arrangement shown in FIG. 16, the locking device 710 can include two or more vertically spaced latch bolts like those described above (not shown) that engage cooperating recesses (not shown) along the free edge 712 of a second swinging window sash panel 702. Indeed, a multi-point locking device according to the invention can be used to fix the free vertical edge of substantially any type of swinging closure panel in a closed position within an opening.

Figure 17:
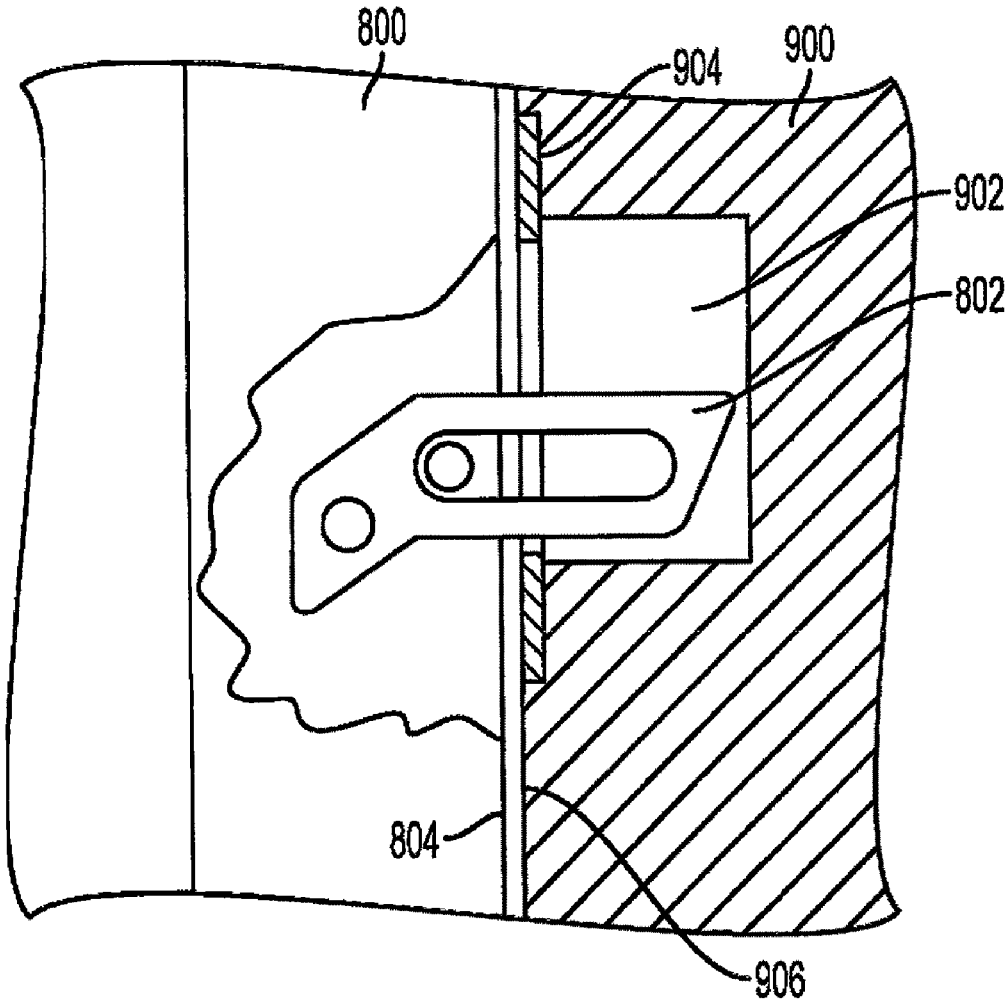
FIG. 17 is a partial cross-sectional view of a portion of a multi-point locking device according to the invention engaged with a recess in an adjacent stationary member.

As shown in FIG. 17, a multi-point lock 800 substantially like those described above can be used to fix the non-hinged edge 804 of a swinging closure panel to a stationary adjacent member 900. The adjacent member 900 can be a jamb, a frame member, or the non-hinged edge 906 of a cooperating inactive closure panel. The multi-point lock 800 includes a plurality of vertically spaced latch bolts 802 (one shown in FIG. 17). Each of the latch bolts 802 is operable to selectively engage an aligned latch bolt recess 902 in the adjacent member 900. The latch bolt recess 902 can include a metal strike plate 904 to reinforce the entrance to recess 902.

The above description of various embodiments of the invention is intended to describe and illustrate various features of the invention, and is not intended to limit the scope of the invention thereto. Persons of ordinary skill in the art will recognize that various modifications can be made to the described embodiments without departing from the invention. All such modifications are intended to be within the scope of the appended claims.

What is claimed is:

1. A multipoint locking system for a pair of cooperating swinging panels that includes an active panel and an inactive panel, the system comprising:

(a) an astragal configured to be externally mounted along a non-hinged vertical edge of the inactive panel, the astragal being operable to selectively fix the inactive panel in a closed position, and including at least one outwardly extending member having a plurality of spaced openings therealong; and (b) a locking mechanism comprising:

(i) an elongated housing configured to be externally mounted along a non-hinged vertical edge of the active panel and including a channel configured to receive the outwardly extending member of the astragal;

(ii) a plurality of spaced latch bolts movably disposed in the housing, each latch bolt being movable between a locked position and an unlocked position, and being aligned with one of the spaced openings in the outwardly extending member when the outwardly extending member is received in the channel; and (iii) at least one actuator positioned within the housing and being operable to move the latch bolts between their locked and unlocked position;

(c) wherein when the active panel and the inactive panel are closed and the latch bolts are moved to their locked positions, each of the latch bolts is received in its aligned opening in the astragal.

2. A multipoint locking system according to claim 1 wherein the latch bolts slide between their locked and unlocked positions.

3. A multipoint locking system according to claim 1 wherein the housing includes a mounting plate configured for attachment to an inside face of the non-hinged vertical edge of the active panel.

4. A multipoint locking system according to claim 1 wherein the housing is configured to substantially cover a vertical gap between the active and inactive panels.

5. A multipoint locking system according to claim 1 wherein the actuator includes at least one vertically sliding member that selectively moves the latch bolts between their locked and unlocked positions.

6. A multipoint locking system according to claim 5 wherein the actuator further includes at least one lever that selectively moves the vertically sliding member between an upper position and a lower position.

7. A multipoint locking system according to claim 1 wherein the housing includes a selectively removable cover.

8. A multipoint locking system according to claim 1 wherein the latch bolts rotate between their locked and unlocked positions.

* * * * *